US007588874B2

(12) United States Patent
Tomita et al.

(10) Patent No.: US 7,588,874 B2
(45) Date of Patent: Sep. 15, 2009

(54) TONER FOR DEVELOPING ELECTROSTATIC IMAGE USED IN ELECTROPHOTOGRAPHY AND PROCESS FOR PRODUCING THE SAME

(75) Inventors: Kazufumi Tomita, Kanagawa (JP); Yosuke Tsurumi, Kanagawa (JP); Shuji Sato, Kanagawa (JP); Akira Matsumoto, Kanagawa (JP); Hiroshi Nakazawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 404 days.

(21) Appl. No.: 10/916,619

(22) Filed: Aug. 12, 2004

(65) Prior Publication Data

US 2005/0175918 A1 Aug. 11, 2005

(30) Foreign Application Priority Data

Feb. 10, 2004 (JP) ..... 2004-032904

(51) Int. Cl.
*G03G 9/08* (2006.01)

(52) U.S. Cl. ..... 430/110.3; 430/108.1; 430/109.3; 430/111.4; 430/123.52; 430/123.54; 430/137.14

(58) Field of Classification Search ..... 430/109.3, 430/108.1, 108.8, 111.4, 110.3, 137.14, 123.52, 430/123.54

See application file for complete search history.

(56) References Cited

U.S. PATENT DOCUMENTS

| | | | | |
|---|---|---|---|---|
| 2,297,691 | A | 10/1942 | Carlson | |
| 3,666,363 | A | 5/1972 | Tanaka et al. | |
| 5,776,649 | A * | 7/1998 | Sorriero et al. | 430/125.6 |
| 6,391,510 | B1 * | 5/2002 | Ishiyama et al. | 430/111.4 |
| 2002/0051925 | A1 * | 5/2002 | Matsumura et al. | 430/110.3 |

FOREIGN PATENT DOCUMENTS

| | | |
|---|---|---|
| JP | A 42-23910 | 11/1967 |
| JP | A 49-91231 | 8/1974 |
| JP | A 56-11461 | 2/1981 |
| JP | A 56-40868 | 4/1981 |
| JP | A 62-39879 | 2/1987 |
| JP | A 62-73276 | 4/1987 |
| JP | A 63-282752 | 11/1988 |
| JP | A 5-27476 | 2/1993 |
| JP | A 6-250439 | 9/1994 |
| JP | A-8-334920 | 12/1996 |
| JP | A-11-143114 | 5/1999 |
| JP | A 2001-117273 | 4/2001 |
| JP | A-2003-241425 | 8/2003 |

OTHER PUBLICATIONS

USPTO English-language translation of JP 2001-117273 (pub. Apr. 2001).*

* cited by examiner

*Primary Examiner*—Janis L Dote
(74) *Attorney, Agent, or Firm*—Oliff & Berridge, PLC

(57) ABSTRACT

A toner for developing an electrostatic image is provided, which contains at least a binder resin, a colorant and a releasing agent, the releasing agent, has an endothermic peak temperature measured by a differential scanning calorimeter of from 60 to 100° C., and an endothermic amount a of the releasing agent per unit weight (J/g) at temperatures equal to or lower than a glass transition onset temperature of the binder resin measured by a differential scanning calorimeter, a total endothermic amount b of the releasing agent per unit weight (J/g) and a volume average particle diameter c(μm) of the toner has the relationship: $0.05 \leqq (a/b) \times c \leqq 0.6$.

14 Claims, No Drawings

TONER FOR DEVELOPING ELECTROSTATIC IMAGE USED IN ELECTROPHOTOGRAPHY AND PROCESS FOR PRODUCING THE SAME

BACKGROUND OF THE INVENTION

1. Field of the Invention

The present invention relates to a toner for developing an electrostatic image used in electrophotography and a process for producing the same.

2. Description of the Related Art

Various processes have been known as electrophotography as described, for example, in U.S. Pat. No. 2,297,691 and JP-B-42-23910 (U.S. Pat. No. 3,666,363). In general, it contains basic process steps, i.e., an exposing step for forming an electrostatic latent image in various methods on a photoreceptor layer utilizing a photoconductive substance, a step of developing the electrostatic latent image with a developer containing a toner, a step of transferring the toner to a recording material, such as paper, a step of fixing the toner image to the recording material by heat, pressure and the like, and a step of removing the toner remaining on the photoreceptor layer.

As the developer used herein, a two-component developer containing a toner and a carrier and a one-component developer using solely a magnetic toner or a non-magnetic toner have been known. A kneading and pulverizing method is generally employed for producing a toner, in which a thermoplastic resin is fused and kneaded with a colorant, a charge controlling agent and a releasing agent, such as wax, and after cooling, the mixture is finely pulverized and classified. Inorganic or organic fine particles are sometimes added to the toner for improving the fluidity and cleaning property thereof. The addition of the fine particles brings about the following problems although an excellent toner can be produced thereby.

In the general kneading and pulverizing method, the toner has an irregular shape and surface structure, which is delicately changed depending on the pulverization property of the material used and the conditions on the pulverization step, and it is thus difficult to control the shape and the surface structure of the toner. Furthermore, there is restriction in selection range of the material in the kneading and pulverizing method. Specifically, it is necessary that the fused and kneaded product is sufficiently brittle before pulverization and can be easily pulverized finely in a production apparatus that can be employed from the economical standpoint. However, in the case where the fused and kneaded product is made brittle to satisfy the requirement, there are some cases where the toner further forms fine powder and causes change in shape due to a mechanical shearing force applied to the toner in a developing device. The phenomena causes such problems that in the two-component developer, the fine powder is stuck on the surface of the carrier to accelerate charge deterioration of the developer, and in the one-component developer, the particle size distribution is broadened to cause scattering of toner and change in toner shape, which brings about poor developing property, whereby the image quality thus obtained is deteriorated.

In the case where a releasing agent, such as wax, is internally added to the toner produced by the pulverizing method, the releasing agent is often restricted to be exposed to the toner surface depending on the combination with the thermoplastic resin. In particular, in a combination of such a resin that is somewhat difficult to be pulverized due to increased elasticity thereof with a high molecular weight component added to the toner, with brittle wax, such as polyethylene, exposure of a large amount of polyethylene on the toner surface is observed. This is advantageous in releasing property upon fixing and in cleaning of an untransferred toner on the photoreceptor, but the polyethylene on the toner surface is easily transferred to the surfaces of the developing roll, the photoreceptor and the carrier by a mechanical force to contaminate them, whereby the reliability is lowered.

The toner sometimes fails to ensure fluidity due to the irregular toner shape even when a fluidity assistant is added thereto, whereby fine particles on the toner surface migrate to depressed parts with a mechanical shearing force in the machine to lower the fluidity of the toner with the lapse of time, and the fluidity assistant is buried into the toner to deteriorate developing property, transfer property and cleaning property. In the case where the toner recovered in the cleaning step is returned to the developing device for reusing, the image quality is further deteriorated. The addition amount of the fluidity assistant is increased to prevent the problems from occurring, such problems occur that black spots are formed, and the fluidity assistant fine particles are scattered.

In view of the circumstances, various production methods of a toner using polymerization, which are different from the kneading and pulverizing method, have been considered. For example, a production method of a toner by suspension polymerization is described, for example, in JP-A-62-73276 and JP-A-5-027476. However, in the case where a toner is prepared in these methods, the controllability of particle size distribution of the toner is substantially equivalent to that of the kneading and pulverizing method, and a classification operation is further necessary in many cases. Furthermore, a toner obtained in these methods has a substantially true spherical shape, which causes considerable deterioration in cleaning property of the toner remaining on a photoreceptor or the like to cause problem in reliability in image quality.

In recent years, a production process of a toner by an emulsion polymerization aggregation method is proposed in JP-A-63-282752 and JP-A-6-250439 as a method for actively controlling the shape and the surface structure of the toner. In the process, a resin dispersion liquid is prepared by an emulsion polymerization method, and a colorant dispersion liquid is separately prepared by dispersing a colorant in a solvent. The dispersion liquids are mixed to form aggregated-particles having a particle diameter corresponding to the particle diameter of the toner, which are then fused and integrated by heating. The process can control the shape to some extent and can improve the charging property and the durability.

There are increasing requirements for a toner used in an electrophotographic process, which is required to have a long service life, a small size, a high processing speed and color reproduction. In particular, a fixing device having high speed operation and small size requires such a toner that is fused at a high temperature in a short period of time, causes no offset contaminating an image, and exhibits stable fixing property on the position of the fixing device and fluctuation in temperature with the lapse of time. In the emulsion polymerization agglomeration method, particularly, further optimization of the composition has been carried out to satisfy the requirements. It is possible that the aggregation degree of the binder resin is increased by increasing the amount of the aggregation agent, so as to prevent offset. However, the acceleration of aggregation increases the amount of coarse particles contained in the toner to cause such problems that the uniformity of the images is deteriorated, and the yield of the toner is significantly lowered. It is also possible that hot offset of the toner is controlled by increasing the amount of the releasing agent but not changing the amount of the aggregating agent, but the amount of wax contained in the toner is increased to lower dispersion property of carbon black in the case of a black toner, whereby the charging property is lowered, and the dielectric loss is increased. As a result, the developing property and the transfer property are deteriorated, and thus, sufficient performance cannot be obtained. In the case where a color image is formed, sufficient coloring property cannot be obtained due to aggregation of the colorants. It is also resulted that the growth of the particle diameter on the particle forming step is lowered, and as a result of increase of the processing temperature, the amount of coarse particles in the toner is increased to cause deterioration in uniformity in images. Furthermore, there is another problem that the image strength (crease) after fixing is deteriorated.

In order to prevent high temperature hot offset from occurring, such a toner for developing an electrostatic image has been proposed that has a melting heat, a glass transition temperature and a melting heat amount satisfying a specific relational equation (see JP-A-2001-117273).

SUMMARY OF THE INVENTION

The invention is to provide such a toner containing a binder resin and a colorant for developing an electrostatic image that is good in fixing property in a wide range of temperature.

As a result of earnest investigations made by the inventors, the toner for developing an electrostatic image of the invention has been attained by employing the following constitutions.

According to a first aspect of the invention, a toner for developing an electrostatic image includes a binder resin, a colorant and a releasing agent, characterized in that the releasing agent has an endothermic peak temperature measured by a differential scanning calorimeter in a range of from 60 to 100° C., and the toner is satisfactory with the following equation:

$$0.05 \leqq (a/b) \times c \leqq 0.6$$

in which a is an endothermic amount of the releasing agent per unit weight (J/g) at temperatures equal to or lower than a glass transition onset temperature of the binder resin, measured by the differential scanning calorimeter, b is a total endothermic amount of the releasing agent per unit weight (J/g) and c is a volume average particle diameter of the toner and is in unit of μm.

According to a second aspect of the invention, a toner for developing an electrostatic image includes a binder resin, a colorant and a releasing agent, characterized in that the releasing agent has an endothermic peak temperature measured by a differential scanning calorimeter in a range of from 70 to 98° C., and the toner is satisfactory with the following equation:

$$0.2 \leqq (a/b) \times c \leqq 0.5$$

in which a is an endothermic amount of the releasing agent per unit weight (J/g) at temperatures equal to or lower than a glass transition onset temperature of the binder resin, measured by the differential scanning calorimeter, b is a total endothermic amount of the releasing agent per unit weight (J/g) and c is a volume average particle diameter of the toner and is in unit of μm.

According to a third aspect of the invention, a method of producing a toner including at least a binder resin, a colorant and a releasing agent for developing an electrostatic image, includes preparing a resin particle dispersion liquid including resin particles having a particle diameter of 1 μm or less dispersed therein, a colorant particle dispersion liquid and a releasing agent dispersion liquid, mixing the resin particle dispersion liquid, the colorant particle dispersion liquid and the releasing agent dispersion liquid, preparing a dispersion liquid of agglomerated particles of the resin particles, colorant particles and releasing agent particles and heating the agglomerated particles at temperatures equal to or higher than a glass transition temperature of the resin particles to fuse and integrate the agglomerated particles, characterized in that the releasing agent has an endothermic peak temperature measured by a differential scanning calorimeter in a range of from 60 to 100° C., and the toner is satisfactory with the following equation:

$$0.05 \leqq (a/b) \times c \leqq 0.6$$

in which a is an endothermic amount of the releasing agent per unit weight (J/g) at temperatures equal to or lower than a glass transition onset temperature of the binder resin, measured by the differential scanning calorimeter, b is a total endothermic amount of the releasing agent per unit weight (J/g) and c is and a volume average particle diameter of the toner and is in unit of μm.

According to a fourth aspect of the invention, a developer for developing an electrostatic image includes a carrier and a toner including a binder resin, a colorant and a releasing agent, characterized in that the releasing agent has an endothermic peak temperature measured by a differential scanning calorimeter in a range of from 60 to 100° C., the toner is satisfactory with the following equations:

$$0.05 \leqq (a/b) \times c \leqq 0.6$$

in which a is an endothermic amount of the releasing agent per unit weight (J/g) at temperatures equal to or lower than a glass transition onset temperature of the binder resin, measured by the differential scanning calorimeter, b is a total endothermic amount of the releasing agent per unit weight (J/g) and c is and a volume average particle diameter of the toner and is in unit of μm.

According to a fifth aspect of the invention, a method for forming an image includes forming an electrostatic latent image on an electrostatic image carrier, developing the electrostatic latent image on the electrostatic image carrier with a developer to form a toner image, transferring the toner image to a transfer material and fixing the toner image, characterized in that the developer includes a carrier and a toner including a binder resin, a colorant and a releasing agent, the releasing agent has an endothermic peak temperature measured by a differential scanning calorimeter of from 60 to 100° C., and the toner is satisfactory with the following equations:

$$0.05 \leqq (a/b) \times c \leqq 0.6$$

in which a is an endothermic amount of the releasing agent per unit weight (J/g) at temperatures equal to or lower than a glass transition onset temperature of the binder resin, measured by the differential scanning calorimeter, b is a total endothermic amount of the releasing agent per unit weight (J/g) and c is and a volume average particle diameter of the toner and is in unit of μm.

By employing the first and second aspect of the invention, such a toner can be provided that is excellent in fixing property in a high speed and high temperature range and fixing stability with fluctuation in temperature and is excellent in dielectric characteristics and image quality, without increase of the amount of coarse particles in the toner.

By employing the fifth and fifth aspect of the invention, such a developer and a process for forming an image can be provided that provide an image with a sufficient density and good image quality for a long period of time.

DETAILED DESCRIPTION OF THE PREFFERD EMBODIMENTS

The invention will be described in detail below.

The toner for developing an electrostatic image according to the invention will be described. In the toner, the releasing agent has an endothermic peak temperature measured by a differential scanning calorimeter of from 60 to 100° C., and an endothermic amount a of the releasing agent per unit weight (J/g) at a temperature equal to or lower than a glass transition onset temperature of the binder resin measured by a differential scanning calorimeter, a total endothermic amount b of the releasing agent per unit weight (J/g) and a volume average particle diameter c (μm) of the toner have the relationship $0.05 \leqq (a/b) \times c \leqq 0.6$.

The releasing agent that can be used in the invention is a substance having an endothermic peak by a differential scanning calorimeter at a temperature of from 60 to 100° C., and preferably from 70 to 98° C. In the case where the endothermic peak temperature is lower than 60° C., the Tg of the toner is lowered, and the amount of aggregated bodies of the toner is increased, so as to deteriorate the image quality. In the case where it exceeds 100° C., the hot offset temperature is lowered.

The endothermic peak of the releasing temperature measured by a differential scanning calorimeter in the invention is obtained in the following manner. By using a differential scanning calorimeter having an automatic tangent line processing system, such as a differential scanning calorimeter, DSC-50, produced by Shimadzu Corp., the releasing agent is subjected to a pretreatment i.e., it is heated from room temperature to 200° C. at a temperature increasing rate of 30° C. per minute, maintained at 200° C. for 10 minutes, cooled from 200° C. to −10° C. at a temperature decreasing rate of 30° C. per minute, and maintained at −10° C. for 10 minutes. The releasing agent is then heated from −10° C. to 200° C. at a temperature increasing rate of 20° C. per minute, and a maximum endothermic peak obtained from the relationship between the temperature (° C.) and the calorie (mW) is designated as the endothermic peak herein.

The toner for developing an electrostatic image of the invention has a value of $(a/b) \times c$ in a range of from 0.05 to 0.6, and preferably from 0.2 to 0.5, wherein a (J/g) represents an endothermic amount of the releasing agent per unit weight at temperatures equal to or lower than a glass transition onset temperature of the binder resin measured by a differential scanning calorimeter, b (J/g) represents a total endothermic amount of the releasing agent per unit weight, and c (μm) represents a volume average particle diameter of the toner. In the case where the value is less than 0.05, the growth of the particle diameter is inhibited to increase the amount of coarse particles. In the case where the value exceeds 0.6, the growth of the particle diameter of the toner is too accelerated, whereby the amounts of fine particles and coarse particles are increased, the Tg of the toner is lowered, and aggregated bodies of the toner are increased, so as to cause deterioration in image quality.

The glass transition onset temperature of the binder resin measured by a differential scanning calorimeter herein is obtained in the following manner. By using a differential scanning calorimeter having an automatic tangent line processing system, such as a differential scanning calorimeter, DSC-50, produced by Shimadzu Corp., the resin is subjected to a pretreatment i.e., it is heated from room temperature to 200° C. at a temperature increasing rate of 10° C. per minute, maintained at 200° C. for 10 minutes, cooled from 200° C. to −10° C. at a temperature decreasing rate of 30° C. per minute, and maintained at −10° C. for 10 minutes. The resin is then heated from −10° C. to 200° C. at a temperature increasing rate of 20° C. per minute, and the first inflection point obtained from the relationship between the temperature (° C.) and the calorie (mW) is designated as the glass transition onset temperature.

The endothermic amount a J/g of the releasing agent per unit weight at a temperature equal to or lower than the glass transition onset temperature of the binder resin measured by a differential scanning calorimeter is obtained in the following manner. The glass transition onset temperature of the binder resin used is previously measured in the aforementioned manner. An endothermic curve of the releasing agent is obtained, and an area between the base line and the endothermic curve in a temperature range of the glass transition onset temperature or lower is divided by the amount of the releasing agent, such as wax. The total endothermic amount b J/g of the releasing agent per unit weight is obtained in the following manner. In the relationship between the temperature (° C.) and the calorie (mW) measured under the conditions for measuring the endothermic peak of the releasing agent, an area of the endothermic peak on the base line is divided by the amount of the releasing agent, such as wax.

The volume average particle diameter c (μm) of the toner means an accumulated volume average particle diameter that can be measured with an apparatus (having an aperture diameter of 100 μm), such as COULTER COUNTER TA-II (produced by Beckman Coulter Co., Ltd.) and MULTISIZER II (produced by Beckman Coulter Co., Ltd.), which are employed as a particle size distribution measurement device.

The average particle diameter of the toner of the invention is preferably from 4 to 8 μm, and particularly preferably from 5 to 7.5 μm. The average particle diameter of the toner is in the aforementioned range, the developing property and the resolution of the image are improved.

The volume average particle size distribution index GSDv can be obtained by using the accumulated volume average particle diameters D16 and D84 according to the equation $GSDv=(D84/D16)^{0.5}$. The GSDv is preferably 1.25 or less, and more preferably 1.24 or less. A toner having a GSDv in the aforementioned range has good transfer performance and can maintain fine high image quality for a long period of time.

The shape of the toner of the invention can be obtained as a shape factor $SF1=(ML^2/A)\times(\pi/4)\times100$ (wherein ML represents the absolute maximum length of the toner particles, and A represents the projected area of the toner particles). The shape factor SF1 is preferably in a range of from 110 to 140, and particularly preferably in a range of from 110 to 138. The shape factor SF1 can be digitalized by analyzing mainly a micrograph or a scanning electron micrograph by an image analyzer (LUZEX image analyzer).

The absolute value of the charge amount of the toner for developing an electrostatic image of the invention is suitably in a range of from 20 to 80 μC/g. In the case where the charge amount is in the range, background stain (fogging) is difficult to occur, and the image density is difficult to be lowered. The ratio between charge amounts in summer season (high temperature and high humidity) and winter season (low temperature and low humidity) is preferably in a range of from 0.5 to 1.5, and more preferably in a range of from 0.7 to 1.3. In the case where the ratio is in the range, it is practically preferred since the environmental dependency of the charging property is low to provide sufficient stability in charging.

Materials used in the toner for developing an electrostatic image according to the invention will be described.

(Binder Resin)

Various kinds of polymers may be used as the binder resin in the invention without particular limitation, and a homopolymer or a copolymer of an ethylenic unsaturated monomer including a vinyl monomer is preferably used. The ethylenic unsaturated monomer including a vinyl monomer is advantageous since a resin particle dispersion liquid can be conveniently produced through emulsion polymerization and seed polymerization using an ionic surfactant. Examples of the monomer constituting the homopolymer or copolymer include a styrene compound, such as styrene, p-chlorostyrene and α-methylstyrene; a (meth)acrylate ester, such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate and 2-ethylhexyl methacrylate; an ethylenic unsaturated nitrile, such as acrylonitrile and methacrylonitrile; an ethylenic unsaturated carboxylic acid, such as acrylic acid, methacrylic acid and crotonic acid; a vinyl ether, such as vinyl methyl ether and vinyl isobutyl ether; a vinyl ketone, such as vinyl methyl ketone, vinyl ethyl ketone and vinyl isopropenyl ketone; and an olefin, such as ethylene, propylene and butadiene. A homopolymer constituting one of the monomers, a copolymer obtained by copolymerizing two or more kinds of them, and a mixture thereof can be used.

Among the monomers, a vinyl polymer acid is preferred from the standpoint of easiness in formation reaction of a vinyl resin, and specifically, a dissociating vinyl monomer having a carboxyl group as a dissociating group, such as acrylic acid, methacrylic acid, maleic acid, cinnamic acid and fumaric acid, are particularly preferred from the standpoint of controlling polymerization degree and glass transition temperature.

Examples thereof further include an epoxy resin, a polyester resin, a polyurethane resin, a polyamide resin, a cellulose resin, a polyether resin, a non-vinyl condensation resin, a mixture of them with the aforementioned ethylenic unsaturated addition polymer resin, and a graft polymer obtained by polymerizing an ethylenic unsaturated monomer in the presence of the resin.

The binder resin used in the toner of the invention can be produced by radical polymerization of a polymerizable monomer. A polymerization initiator used herein is not particularly limited, and specific examples thereof include a peroxide, such as hydrogen peroxide, acetyl peroxide, cumyl peroxide, tert-butyl peroxide, propionyl peroxide, benzoyl peroxide, chlorobenzoyl peroxide, dichlorobenzoyl peroxide, bormomethylbenzoyl peroxide, lauroyl peroxide, ammonium peroxide, sodium peroxide, potassium peroxide, peroxy diisopropyl carbonate, tetralin hydroperoxide, 1-phenyl-2-methylpropyl-1-hydroperoxide, tert-butyl pertriphenylacetate hydroperoxide, tert-butyl performate, tert-butyl perbenzoate, tert-butyl perphenylacetate, tert-butyl permethoxyacetate and tert-butyl per-N-(3-toluyl)carbamate; an azo compound, such as 2,2'-azobispropane, 2,2'-dichloro-2,2'-azobispropane, 1,1'-azo(methylethyl)diacetate, 2,2'-azobis(2-diaminopropane)hydrochloride, 2,2'-azobis(2-diaminopropane)nitrate, 2,2'-azobisisobutane, 2,2'-azobisisobutylamide, 2,2'-azobisisobutylonitrile, methyl 2,2'-azobis-2-methylpropionate, 2,2'-dichloro-2,2'-azobisbutane, 2,2'-azobis-2-methylbutyronitrile, dimethyl 2,2'-azobisisobutyrate, 1,1'-azobis(sodium 1-methylbutyronitrile-3-sulfonate), 2-(4-methylphenylazo)-2-methylmalonodinitrile, 4,4'-azobis-4-cyanovaleric acid, 3,5-dihyrdoxymethylphenylazo-2-methylmalonodinitrile, 2-(4-bromophenylazo)-2-allylmalonodinitrile, 2,2'-azobis-2-methylvaleronitrile, dimethyl 4,4'-azobis-4-cyanovalerate, 2,2'-azobis-2,4-dimethylvaleronitrile, 1,1'-azobiscyclohexanenitrile, 2,2'-azobis-2-propylbutyronitrile, 1,1'-azobis-1-chlorophenylethane, 1,1'-azobis-1-cyclohexanecarbonitrile, 1,1'-azobis-1-cycloheptanecarbonitrile, 1,1'-azobis-1-phenylethane, 1,1'-azobiscumene, ethyl 4-nitrophenylazobenzylcyanoacetate, phenylazodiphenylmethane, phenylazotriphenylmethane, 4-nitrophenylazotriphenylmethane, 1,1'-azobis-1,2-diphenylethane, poly(bisphenol A-4,4'-azobis-4-cyanopentanoate) and poly(tetraethylene glycol-2,2'-azobisisobutyrate); 1,4-bis(pentaethylene)-2-tetrazene, and 1,4-dimethoxycarbonyl-1,4-diphenyl-2-tetrazene.

(Releasing Agent)

A releasing agent having an endothermic peak temperature measured by a differential scanning calorimeter of from 60 to 100° C. is used in the toner of the invention.

In the temperature range equal to or lower than the Tg of the binder resin, the releasing agent preferably has no endothermic peak to prevent the particle size distribution of the toner from being broadened.

Specific examples of a substance that can be used as the releasing agent in the invention include low molecular weight polyolefin wax, such as polyethylene, polypropylene and polybutene; vegetable wax, such as carnauba wax, rice wax, candelilla wax, haze wax, jojoba oil, sugar wax and palm wax; animal wax, such as bees wax, mineral or petroleum wax, such as montan wax, ozokerite, ceresin, paraffin wax, oxidized paraffin wax and microcrystalline wax; synthetic wax, such as polyolefin wax, oxidized polyolefin wax and Fischer-Tropsch wax; and a modified product thereof. These substances may be used solely or as a mixture.

It is preferred that the releasing agent used in the invention is dispersed as particles having an average particle diameter of from 150 to 1,500 nm in the toner for developing an electrostatic image in an amount of from 5 to 25% by weight based on the total weight of the toner. The use of the releasing agent improves releasing property of a fixed image on the oilless fixing method. The average particle diameter is more preferably from 160 to 1,400 nm, and the amount is more preferably from 7 to 23% by weight.

(Colorant)

Known colorants may be used in the invention. Examples of a black pigment include carbon black, such as furnace black, channel black, acetylene black and thermal black, copper oxide, manganese dioxide, titanium oxide, aniline black, activated carbon, non-magnetic ferrite and magnetite. Examples of a yellow pigment include chrome yellow, zinc yellow, yellow iron oxide, cadmium yellow, Hansa Yellow, Hansa Yellow 10G, Benzidine Yellow G, Benzidine Yellow GR, Threne Yellow, Quinoline Yellow and Permanent Yellow NCG.

Examples of an orange pigment include red chrome yellow, molybdenum orange, Permanent Orange GTR, Pyrazolone Orange, Vulkan Orange, Benzidine Orange G and Indanthrene Brilliant Orange GK.

Examples of a red pigment include red iron oxide, cadmium red, red lead, mercury sulfide, Watchyoung Red, Permanent Red 4R, Lithol Red, Brilliant Carmine 3B, Brilliant Carmine 6B, Du Pont Oil Red, Pyrazolone Red, Rhodamine B Lake, Lake Red C, Rose Bengal, Eosine Red and Alizarin Lake.

Examples of a blue pigment include ultramarine, cobalt blue, Alkali Blue Lake, Victoria Blue Lake, Fast Sky Blue, Indanthrene Blue BC, Aniline Blue, Ultramarine Blue, Calco Oil Blue, Methylene Blue Chloride, Phthalocyanine Blue, Phthalocyanine Green and Malachite Green Oxalate. Examples of a violet pigment include Manganese Violet, Fast Violet B and Methyl Violet Lake.

Examples of a green pigment include chromium oxide, Chromium Green, Pigment Green, Malachite Green Lake and Final Yellow Green G.

Examples of a white pigment include zinc white, titanium oxide, antimony white and zinc sulfate.

Examples of a body pigment include barytes, barium carbonate, clay, silica, white carbon, talc and alumina white.

Furthermore, examples of a dye include various dyes, such as basic, acidic, dispersion and direct dyes, for example, nigrosine, Methylene Blue, Rose Bengal, Quinoline Yellow and Ultramarine Blue.

The colorants may be used solely or as a mixture, and may also be used in the form of a solid solution.

There are some cases where the colorant is used after dispersing in an aqueous system with a surfactant having polarity by a homogenizer. In the cases, polar resin fine particles having an acid value of from 10 to 50 mgKOH/g and a volume average particle diameter of 100 nm or less may be used in an amount of from 0.4 to 10% by weight, and preferably from 1.2 to 5.0% by weight, to coat the colorant.

The resin fine particles can be coated in the known method. Specifically, the colorant particles and ion exchanged water are properly mixed to produce a colorant particle dispersion liquid by using the arbitrary dispersing machine, to which the polar resin fine particles are then added and attached. It is also possible that the colorant particles and ion exchanged water are properly mixed and dispersed by using the arbitrary dispersing machine, to which the polar resin fine particles are then added thereto, followed by homogenizing, so as to attach them to the colorant particles. Furthermore, the polar resin fine particles may be added to the colorant particle dispersion liquid at a time or stepwise, and it is preferred that the polar resin fine particles are gradually added dropwise from the standpoint of adhesion property.

The colorant in the invention is selected from the standpoint of hue angle, chroma, brightness, weather resistance, OHP transparency and dispersibility in the toner. The addition amount of the colorant may be from 1 to 20% by weight based on the total weight of the resin in the toner. In the case where a magnetic material is used as a black colorant, it may be added in an amount of from 30 to 100% by weight as different from the case of the other colorants.

In the case where the colorant in the invention is dispersed as particles having an average particle diameter of from 100 to 330 nm in the toner for developing an electrostatic image in an amount of from 4 to 15% by weight, not only the coloring property is improved, but also the OHP transparency is improved. The average particle diameter is preferably from 120 to 310 nm, and the addition amount is preferably from 5 to 14% by weight.

(Magnetic Powder)

In the case where the toner of the invention is used as a magnetic toner, magnetic powder may be contained in the binder resin. A substance that is magnetized in a magnetic field is used as the magnetic powder. Specific examples thereof include an elemental metal, such as iron, cobalt and nickel, a ferromagnetic alloy thereof, and a compound, such as ferrite and magnetite. In particular, it is necessary in the invention that the aqueous phase transition property of the magnetic material is to be noted for obtaining the toner in the aqueous phase, and it is preferred that the magnetic powder is subjected to surface modification, such as a hydrophobic treatment.

(Other Additives)

In the toner of the invention, other components (particles), such as an internal additive, a charge controlling agent, an organic particles, a lubricant and an abrasive, maybe added in addition to the aforementioned resin, colorant and releasing agent.

(Charge Controlling Agent)

In the invention, a charge controlling agent may be added for further improving the charging property of the toner for stabilization. Preferred examples of the charge controlling agent include a metallic salt of benzoic acid, a metallic salt of salicylic acid, a metallic salt of alkylsalycylic acid, a metallic salt of catechol, a metal-containing bisazo dye, a tetraphenylborate derivative, a quaternary ammonium salt, an alkyl pyridinium salt, a nigrosine compound, a dye containing a complex of iron, chromium or the like, a triphenylmethane pigment, a resin type charge controlling agent having polar groups, and combination of them. Among these, those materials that are difficult to be dissolved in water are preferred for controlling the ion intensity, which influences on agglomeration and stability upon fusing and integrating, and for reducing contamination of waste water. In general, the addition amount of the charge controlling agent is preferably 10% by weight or less based on the solid content of the toner.

(Fine Particles)

In the invention, inorganic fine particles may be added in a wet method for stabilizing the charging property of the toner. Examples of the inorganic fine particles include those generally used as an external additive to the toner surface, such as silica, alumina, titania, calcium carbonate, magnesium carbonate and tricalcium phosphate. The inorganic fine particles maybe used after dispersing in an ionic surfactant, a polymer acid or a polymer base.

In order to impart fluidity or to improve the cleaning property, fine particles may be added to the toner surface by applying a shearing force in a dry state, as similar to the ordinary toners. Specific examples of the fine particles include inorganic fine particles, such as a metallic salt, e.g., calcium carbonate, a metallic oxide compound, such as silica, alumina, titania, barium titanate, strontium titanate, calcium titanate, cerium oxide, zirconium oxide and magnesium oxide, ceramics and carbon black, and resin fine particles, e.g., a vinyl resin, polyester and silicone.

The inorganic fine particles is preferably treated with a coupling agent or the like for controlling the electroconductivity and the charging property, and specific examples of the coupling agent include a silane coupling agent, such as methyltrichlorosilane, methyldichlorosilane, dimethyldichlorosilane, trimethylchlorosilane, phenyltrichlorosilane, diphenyldichlorosilane, tetramethoxysilane, methyltrimethoxysilane, dimethyldimethoxysilane, phenyltrimethoxysilane, diphenyldimethoxysilane, tetraethoxysilane, methyltriethoxysilane, dimethyldiethoxysilane, phenyltriethoxysilane, diphenyldiethoxysilane, isobutyltrimethoxysilane, decyltrimethoxysilane, hexamethylsilazane, N,N-(bistrimethylsilyl)acetamide, N,N-bis(trimethylsilyl)urea, tert-butyldimethylchlorosilane, vinyltrichlorosilane, vinyltrimethoxysilane, vinyltriethoxysilane, γ-methacryloxypropyltrimethoxysilane, β-(3,4-epoxycyclohexyl)ethyltrimethoxysilane, γ-glycidoxypropyltrimethoxysilane, γ-glycidoxypropylmethyldiethoxysilane, γ-mercaptopropyltrimethoxysilane and γ-chloropropyltrimethoxysilane, and a titanium coupling agent.

The process for producing a toner for developing an electrostatic image according to the invention will be described. In the toner, the releasing agent has an endothermic peak temperature measured by a differential scanning calorimeter of from 60 to 100° C., and an endothermic amount a (J/g) of the releasing agent per unit weight at a temperature equal to or lower than a glass transition onset temperature of the binder resin measured by a differential scanning calorimeter, a total endothermic amount b (J/g) of the releasing agent per unit weight and a volume average particle diameter c (μm) of the toner have the relationship $0.05 \leqq a/(b \times c) \leqq 0.6$.

The process for producing a toner for developing an electrostatic image according to the invention includes the kneading and pulverizing method, the suspension polymerization method, in which a colorant, a releasing agent and the like are suspended along with a polymerizable monomer, and the polymerizable monomer is polymerized, the dissolution suspension method, in which toner constituting materials, such as a colorant and a releasing agent, are dissolved in an organic solvent, and dispersed in an aqueous solvent to form a suspended state, and then the organic solvent is removed, and the emulsion polymerization, aggregation, fusion and integration method, in which a resin is produced by emulsion polymerization, which is subjected to hetero agglomeration with dispersion liquids of a pigment, a releasing agent and the like, followed by effecting fusion and integration, but the invention is not limited thereto. Among these, the emulsion polymerization, agglomeration, fusion and integration method is most preferred.

The toner for developing an electrostatic image according to the invention can be generally obtained by such a production process that contains a step of preparing a resin fine particle dispersion liquid containing an ionic surfactant by emulsion polymerization or the like, a step of preparing a colorant particles dispersion liquid and a releasing agent particle dispersion liquid, a step of mixing the dispersion liquids, a step of preparing agglomerated particle dispersion liquid of the resin fine particles, the colorant particles and the releasing agent particles through hetero aggregation by an aggregating agent having a polarity opposite to the ionic surfactant, a step of fusing and integrating the aggregated particles by heating to a temperature equal to or higher than the glass transition temperature of the resin fine particles, a washing step, and a drying step.

(Resin Fine Particle Dispersion Liquid Preparing Step)

In the case where a homopolymer or a copolymer of a vinyl monomer is used as the binder resin, the resin fine particle dispersion liquid can be produced by effecting emulsion polymerization by using an ionic surfactant or the like. In the case of the other resins that can be dissolved in an oil-based solvent having relatively low solubility to water, the resin fine particle dispersion liquid can be produced in such a manner that the resin is dissolved in the solvent and dispersed as fine particles along with a surfactant and a polymer electrolyte in water by a homogenizer or the like, and then the solvent is evaporated by heating or reducing pressure.

(Releasing Agent Particle Dispersion Liquid Preparing Step)

The releasing agent may be dispersed in water along with an ionic surfactant and a polymer electrolyte, such as a polymer acid and a polymer base, and is formed into fine particles by applying a strong shearing force by using a homogenizer or a pressure discharge dispersing machine, so as to produce a releasing agent particle dispersion liquid having a particle diameter of 1 μm or less.

The concentration of the surfactant used in the releasing agent dispersion liquid is preferably 4% by weight or less based on the releasing agent. The aforementioned range is preferred since the agglomeration rate of particle formation is increased to reduce the heating time, and the amount of the agglomerated bodies is not increased.

(Colorant Particle Dispersion Liquid Preparing Step)

The colorant may be dispersed by the known method, and for example, such dispersing machines are preferably used as a rotation shearing homogenizer, a media dispersing machine, such as a ball mill, a sand mill, an attritor and a co-ball mill, a roll mill, such as three-roll mill, a cavitation mill, such as a nanomizer, a colloid mill, and a high pressure counter collision dispersing machine.

In the emulsion polymerization, aggregation, fusion and integration method, an aqueous medium may be used as dispersion media for the resin particle dispersion liquid, the colorant particle dispersion liquid, the releasing agent dispersion liquid and dispersion liquids of the other components. Examples of the aqueous medium include water, such as distilled water and ion exchanged water, and an alcohol. These may be used solely or in combination of two or more of them.

(Dispersion Liquids Mixing Step and Fusing and Integrating Step)

In the mixing step of the resin particle dispersion liquid, the colorant particle dispersion liquid and the releasing agent particle dispersion liquid, the balance of the ionic surfactants having respective polarities is deviated in the initial stage, and then it is ionically neutralized by adding a polymer of an inorganic metallic salt, such as polyaluminum chloride. Thereafter, mother aggregated particles of the first step are formed at a temperature equal to or lower than the glass transition temperature, and after being stabilized, the resin fine particle dispersion liquid treated with an ionic dispersant of such polarity and amount that compensate the deviation in ionic balance is added as the second step, so as to prepare the agglomerated particle dispersion liquid. Furthermore, it is possible, depending on necessity, that the dispersion liquid is slightly heated to a temperature equal to or lower than the glass transition temperature of the resin fine particles in the aggregated particles and the resin contained in the additional resin fine particles to stabilize at a higher temperature, and then heated to a temperature higher than the glass transition temperature to effect integration in such a state that the particles added in the second step of agglomeration formation are attached to the surface. The stepwise agglomeration operation may be repeated plural times. The two-step method is effective for improving encompassment of the releasing agent and the colorant.

It is preferred in the invention that the releasing agent particles are coated after forming the aggregated particles, and coated with the resin fine particles for modifying the surface.

In the aggregation step, the aggregated particles are formed through heteroaggregation. In order to stabilize the aggregated particles and to control the particle size and the particle size distribution, anionic surfactant having a polarity different from the aggregated particles or a compound containing a metallic salt is added.

In the preparing step of the aggregated particle dispersion liquid in the emulsion polymerization, aggregation, fusion and integration method, an inorganic metallic salt having two or more valences may be used as an agglomerating agent, and specific examples thereof include magnesium chloride, aluminum sulfate, calcium sulfate, aluminum sulfate, copper sulfate and polyaluminum chloride. Among these, polyaluminum chloride is preferred from the standpoint of stability of the agglomerated particles and stability of the agglomerating agent to heat and time lapse.

In the fusing step, the resin is fused by heating to a temperature equal to or higher than the glass transition temperature thereof.

In the attaching step, a fine particle dispersion liquid is added to the aggregated particle dispersion liquid to attach the fine particles uniformly on the surface of the aggregated particles as the mother particles, so as to form attached particles. The attached particles are also formed through hetero-aggregation. In the integration step, the resin in the attached particles is melted for integration to form toner particles for developing an electrostatic image.

As described hereinabove, in the emulsion polymerization, aggregation, fusion and integration method, the resin particles and the like are aggregated and heated to fuse and integrate the resin particles, whereby the shear is reduced. Furthermore, the releasing agent and the colorant can be uniformly encompassed in the toner owing to fusion and integration of the particles, whereby the composition on the surface of the toner can be easily made uniform.

In the production process of a toner according to the invention, a surfactant may be used for emulsion polymerization of the resin fine particles, dispersion of the colorant, addition and dispersion of the resin fine particles, dispersion of the releasing agent, aggregation of them, and stabilization of them. Examples of the surfactant include an anionic surfactant, such as a sulfate ester salt compound, a sulfonate salt compound, a phosphate ester compound and a soap compound, and a cationic surfactant, such as an amine salt compound and a quaternary ammonium salt compound. It is also effective that a nonionic surfactant, such as a polyethylene glycol compound, an alkylphenol ethylene oxide adduct and a polyhydric alcohol, is used in combination. Among these, an ionic surfactant including an anionic surfactant and a cationic surfactant is preferred.

In general, an anionic surfactant has strong dispersing power and is suitable for dispersing the resin particles and the colorant, and a cationic surfactant is suitable for dispersing the releasing agent. A nonionic surfactant is preferably used in combination with an anionic surfactant or a cationic surfactant. The surfactant may be used solely or in combination of two or more of them.

Specific examples of the anionic surfactant include an aliphatic soap, such as sodium laurate, sodium oleate and sodium castor oil; a sulfate ester, such as octyl sulfate, lauryl sulfate, lauryl ether sulfate and nonylphenyl ether sulfate; a sulfonate salt, such as lauryl sulfonate, dodecylbenzene sulfonate, a sodium alkylnaphthalenesulfonate, such as sodium triisopropylnaphthalenesulfonate and sodium dibutylnaphthalenesulfonate, a condensate of naphthalenesulfonate and formalin, monooctyl sulfosuccinate, dioctyl sulfosuccinate, lauric acid amide sulfonate and oleic acid amide sulfonate; a phosphate ester, such as lauryl phosphate, isporopyl phosphate and nonylphenyl ether phosphate; and a sulfosuccinate salt, such as a dialkyl sulfosuccinate, e.g., sodium dioctyl sulfosuccinate, and disodium lauryl sulfosuccinate.

Specific examples of the cationic surfactant include an amine salt, such as lauryl amine hydrochloride, stearyl amine hydrochloride, oleyl amine acetate, stearyl amine acetate and stearyl aminopropylamine acetate; and a quaternary ammonium salt, such as lauryl trimethyl ammonium chloride, dilauryl dimethyl ammonium chloride, distearyl ammonium chloride, distearyl dimethyl ammonium chloride, lauryl dihydroxyethyl methyl ammonium chloride, oleyl bispolyoxyethylene methyl ammonium chloride, lauroyl aminopropyl dimethyl ethyl ammonium ethosulfate, lauroyl aminopropyl dimethyl hydroxyethyl ammonium perchlorate, alkylbenzene dimethyl ammonium chloride and alkyl trimethyl ammonium chloride.

Specific examples of the nonionic surfactant include an alkyl ether, such as polyoxyethylene octyl ether, polyoxyethylene lauryl ether, polyoxyethylene stearyl ether and polyoxyethylene oleyl ether; an alkyl phenyl ether, such as polyoxyethylene octyl phenyl ether and polyoxyethylene nonyl phenyl ether; an alkyl ester, such as polyoxyethylene laurate, polyoxyethylene stearate and polyoxyethylene oleate; an alkylamine, such as polyoxyethylene lauryl amino ether, polyoxyethylene stearyl amino ether, polyoxyethylene oleyl amino ether, polyoxyethylene soybean amino ether and polyoxyethylene beef tallow amino ether; an alkylamide, such as polyoxyethylene lauric acid amide, polyoxyethylene stearic acid amide and polyoxyethylene oleic acid amide; a vegetable oil ether, such as polyoxyethylene castor oil ether and polyoxyethylene rapeseed oil ether; an alkanolamide, such as lauric acid diethanolamide, stearic acid diethanolamide and oleic acid diethanolamide; and sorbitan ester ether, such as polyoxyethylene sorbitan monolaurate, polyoxyethylene sorbitan monopalmitate, polyoxyethylene sorbitan monostearate and polyoxyethylene sorbitan monooleate.

The surfactant may be dispersed by the ordinary method, and for example, such dispersing machines may be used as a rotation shearing homogenizer, a media dispersing machine, such as a ball mill, a sand mill and a Dinor mill.

In the case where colorant particles coated with polar resin fine particles are used, they can be obtained, for example, in the following methods. The resin and the colorant are dissolved and dispersed in a solvent (such as water, a surfactant and an alcohol) and then dispersed in water along with the aforementioned suitable dispersant (including an activating agent), and the solvent is removed by heating or reducing pressure. The colorant particles are fixed to the surface of the resin fine particles prepared by emulsion polymerization through mechanical shearing force or electrical adsorption force. These methods are effective for suppressing release of the colorant added to the aggregated particles and for improving the colorant dependency of the charging property.

Fine particles may be added for imparting fluidity or for improving the cleaning property. The fine particles may be added in such a method that after drying the toner, the fine particles are attached to the toner surface in a dry process by using a mixer, such as a V blender and a Henschel mixer, or in alternative, the fine particles are dispersed in an aqueous liquid, such as water and an alcohol, and then added to the toner in a slurry form, followed by drying, to attach the external additive to the toner surface. It is also possible that the slurry is dried by spraying on the dry powder.

In the invention, the desired toner can be obtained through a washing step, a solid-liquid separating step and a drying step, which are carried out arbitrarily after completing the fusing and integrating step. In the washing step, it is preferred that substitution washing is sufficiently carried out with ion exchanged water for exhibiting and maintaining the charging property. The solid-liquid separating step is not particularly limited, and suction filtration, pressure filtration, centrifugal filtration and decantation are preferably employed from the standpoint of productivity.

The drying step is also not particularly limited, and a through-flow dryer, a spray dryer, a rotation dryer, an air flow dryer, a fluidized bed dryer, a heat transmission heating dryer and a freeze dryer are preferably used from the standpoint of productivity.

The toner for developing an electrostatic image using a resin having a crosslinking agent introduced therein as a binder resin, having a volume average particle diameter of from 3 to 9 μm, and having relationship between an amount of an inorganic metallic salt and an amount of the crosslinking agent restricted to a prescribed range will be described. According to the aforementioned constitution, the invention provides such a toner that has a broad fixing range irrespective to temperature fluctuation of a fixing member upon continuous duplication and high speed duplication.

In the invention, a toner having a broad fixing range can be obtained by a value X in the following equation (1), which is a function of the amount of the inorganic metallic salt and the amount of the releasing agent, in a range of from 97 to 250:

$$X=874.8\times B/4\times C+23.1\times D-58.2 \quad (1)$$

wherein B represents the valence number of the inorganic metallic salt, C represents the addition amount of the inorganic metallic salt, and D represents the concentration of the crosslinking agent.

In the equation (1), the addition amount of the inorganic metallic salt means an addition amount (solid content) of the inorganic metallic salt expressed as percent by weight based on the total weight of the total solid content of the toner.

In the equation (1), the concentration of the crosslinking agent means an addition amount of the crosslinking agent expressed as percent based on the total weight of the binder resin.

In the case where the value X is less than about 97, the amounts of the inorganic metallic salt and the covalent bond crosslinking are short, and the sufficient fixing range cannot be ensured. In the case where the value X exceeds 250, it is not preferred since such problems occur upon production as deteriorated agglomeration property or increase of the amount of coarse particles. In the case where the value X is in a range of from 97 to 250, a toner is excellent in fixing characteristics in a wide range of temperature. The value X is preferably in a range of from 100 to 160.

The volume average particle diameter of the toner is from 3 to 9 μm, and preferably from 4 to 8 μm. The aforementioned range is preferred since the surface of the fixed image becomes smooth to cause less unevenness in glossiness, and the service life of the developer is not shortened.

The volume average particle diameter of the toner means an accumulated volume average particle diameter that can be measured with an apparatus (having an aperture diameter of 100 μm), such as COULTER COUNTER TA-II (produced by Beckman Coulter Co., Ltd.) and MULTISIZER II (produced by Beckman Coulter Co., Ltd.), which are employed as a particle size distribution measurement device.

The toner suitably has a weight average molecular weight Mw of 20,000 or more for ensuring the fixing range. It is preferably 25,000 to 90,000, and more preferably from 30,000 to 70,000. In the case where the weight average molecular weight Mw is in the aforementioned range, hot offset in a high temperature fixing range can be prevented from occurring.

The toner of the toner preferably has a glass transition temperature (Tg) of from 45 to 70° C., more preferably from 47 to 65° C., and further preferably from 55 to 60° C. In the case where the Tg is in the aforementioned range, the calorie required for fixing the toner is not increased to attain electric power saving and high speed operation of the toner.

(Binder Resin)

The resin that can be used as the binder resin is the same as the aforementioned resins described as being used as the binder resin. The binder resin preferably has a glass transition onset temperature of from 45 to 70° C.

In the toner of the invention, a crosslinking agent is necessarily added in addition to the aforementioned monomer. In the case where a binder resin is polymerized by using a crosslinking agent, in general, decrease of the viscosity of the binder resin is lowered in a high temperature region, and it is effective for suppressing hot offset from occurring. In particular, an aliphatic compound crosslinking agent is excellent in elasticity, and in the case where crosslinking is effected by using the same, the increase of the viscosity of the resin can be conveniently controlled, so as to provide such an advantage that hot offset can be suppressed from occurring whilst the resistance to cracking of the fixed image against bending is maintained.

A binder resin having an aromatic compound as the crosslinking agent can provide the desired characteristics in the initial stage, but the cracking property of the fixed image is difficult to be controlled in the low gloss region due to the poor elasticity of the aromatic compound. Therefore, it is preferred to use an aliphatic compound as the crosslinking agent for further improving the fixing characteristics.

Specific examples of the aliphatic compound crosslinking agent include a (meth)acrylate ester of a linear polyhydric alcohol, such as butanediol methacrylate, hexanediol acrylate, octanediol methacrylate, decanediol acrylate and dodecanediol methacrylate; a (meth)acrylate ester of a branched or substituted polyhydric alcohol, such as neopentylglycol dimethacrylate and 2-hydroxy-1,3-diacryloxypropane; polyethylene glycol di(meth)acrylate; polypropylene polyethylene glycol(meth)acrylate; and a divinyl ester of a polybasic carboxylic acid, such as divinyl succinate, divinyl adipate, divinyl suberate and divinyl sebacate. In the toner of the invention, these crosslinking agent may be used solely or in combination of two or more of them.

The addition amount of the crosslinking agent in the binder resin is suitably from 0.1 to 3% by weight, preferably from 0.3 to 2.0% by weight, and more preferably from 0.5 to 1.5% by weight. In the case where the amount is in the aforementioned range, such an effect is obtained owing to the addition of the crosslinking agent that less unevenness in glossiness occurs, and the viscosity of the binder resin is difficult to be increased to improve transparency.

(Releasing Agent)

The releasing agent used in the invention is the same as those described hereinabove.

The addition amount of the releasing agent is suitably from 0.5 to 50% by weight, preferably from 1 to 30% by weight, and more preferably from 5 to 15% by weight, based on the toner. The effect of addition of the releasing agent can be obtained in the aforementioned range. Furthermore, it exhibits a suitable exposure amount on the toner surface to improve the fluidity and the charging characteristics.

The melting point of the releasing agent, such as wax, is preferably from 40 to 150° C., and more preferably from 50 to 120° C.

(Colorant)

The colorant used in the invention is the same as those described hereinabove.

(Inorganic Metallic Salt)

The toner of the invention contains an inorganic metallic salt having two or more valences. Specific examples of the inorganic metallic salt having two or more valences include magnesium chloride, aluminum sulfate, calcium sulfate, aluminum nitrate, copper nitrate and polyaluminum chloride. Among these, polyaluminum chloride is preferred from the standpoint of stability of the agglomerated particles and stability of the aggregating agent to heat and time lapse.

The addition amount of the inorganic metallic salt is preferably from 0.05 to 1.0% by weight, and more preferably from 0.15 to 0.30% by weight, per 100% by weight of the total solid content of the toner.

(Production Process)

The toner using the binder resin having the crosslinking agent introduced therein, having a volume average particle diameter of from 3 to 9 μm, and having relationship between an amount of an inorganic metallic salt and an amount of the crosslinking agent restricted to a prescribed range can be produced by using the aforementioned materials in the same manner as those described hereinabove.

The developer for developing an electrostatic image according to the invention will be described.

The developer for developing an electrostatic image according to the invention contains the aforementioned toner for developing an electrostatic image, and may contain other components depending on necessity. The developer for developing an electrostatic image according to the invention may be prepared as a one-component developer for developing an electrostatic image by using solely the aforementioned toner for developing an electrostatic image, and may be prepared as a two-component developer for developing an electrostatic image by using a carrier in combination therewith. The carrier is not particularly limited. For example, the known carriers, such as the resin-coated carriers described in JP-A-62-39879 and JP-A-56-11461 maybe used.

(Carrier)

Examples of core particles of the resin-coated carrier include iron powder, ferrite and magnetite, and the average diameter thereof may be from 30 to 200 μm. Examples of the coated resin include a homopolymer of a styrene compound, such as styrene, parachlorostyrene and α-methylstyrene, an α-methylene aliphatic acid monocarboxylate, such as methyl acrylate, ethyl acrylate, n-propyl acrylate, lauryl acrylate, 2-ethylhexyl acrylate, methyl methacrylate, n-propyl methacrylate, lauryl methacrylate and 2-ethylhexyl methacrylate, a nitrogen-containing acrylic compound, such as dimethylaminoethyl methacrylate, a vinylnitrile compound, such as acrylonitrile and methacrylonitril, a vinylpyridine compound, such as 2-vinylpyridine and 4-vinylpyridine, a vinyl ether compound, such as vinyl methyl ether and vinyl isobutyl ether, a vinyl ketone compound, such as vinyl methyl ketone, vinyl ethyl ketone and vinyl isopropenyl ketone, an olefin, such as ethylene and propylene, and a fluorine-containing vinyl monomer, such as vinylidene fluoride, tetrafluoroethylene and hexafluoroethylene, a copolymer formed from two or more kinds thereof, a silicone compound, such as methylsilicone and methylphenylsilicone, a polyester containing bisphenol or glycol, an epoxy resin, a polyurethane resin, a polyamide resin, a cellulose resin, a polyether resin, and a polycarbonate resin. These resins maybe used solely or in combination of two or more of them.

The amount of the coated resin is preferably from 0.1 to 10 parts by weight, and more preferably from 0.5 to 3.0 parts by weight, per 100 parts by weight of the core particles. Production of the carrier can be carried out by using a heating kneader, a heating Henschel mixer and an UM mixer, and depending on the amount of the coated resin, a heating fluidized rolling bed and a heating kiln may also be used. The mixing ratio of the toner and the carrier in the developer for developing an electrostatic image is not particularly limited and can be selected depending on purposes.

(Process for Forming Image)

The process for forming an image according to the invention contains a step of forming an electrostatic latent image on an electrostatic image carrier; a step of developing the electrostatic latent image on the electrostatic image carrier with a developer for developing an electrostatic image containing a toner to form a toner image; a step of transferring the toner image to a transfer material; and a step of fixing the toner image. The steps themselves are those having been ordinarily employed in the art and described, for example, in JP-A-56-40868 and JP-A-49-91231. The process for forming an image according to the invention can be practiced by a known image forming apparatus, such as a duplicating machine and a facsimile machine. The toner of the invention is particularly effective in a system having a process speed of the latent image carrier of 300 mm/s or more.

The formation of an electrostatic latent image is to form an electrostatic latent image on an electrostatic latent image carrier, and the formation of a toner image is to form a toner image by developing the electrostatic latent image with a developer carried on a developer carrier. The transferring is to transfer the toner image to a fixing material, and the fixing is to fix the toner image transferred to the fixing material by applying heat from a fixing member.

The fixing member preferably has smaller surface energy to prevent advantageously the fused toner from being attached thereto upon fixing. Specifically, in the case where the contact angle with water is larger, it is advantageous in attachment of the fused toner. The contact angle with water is preferably about 80° or more, more preferably 90° or more, and further preferably 100° or more. In the case where the contact angle with water is less than 80°, it is not preferred since attachment of the fused toner is liable to occur, and the toner attached to the fixing member is again attached to the fixing member to cause offset.

In the fixing step, a fixing material, such as paper, is passed between the two fixing members, during which the toner image on the fixing material is fixed by fused through heating. The fixing members are in a form of a roll or a belt, and at least one of them is equipped with a heating device. The fixing member may be a roll or a belt as it is, or may be used after coating a resin thereon.

The fixing roll may be produced by coating silicone rubber, Viton rubber or the like on a surface of a core material.

The fixing belt may be formed by using solely or in combination of two or more of polyamide, polyimide, polyethylene terephthalate, polybutylene terephthalate and the like. Examples of the coating resin for the roll and the belt include a homopolymer of a styrene compound, such as styrene, parachlorostyrene and α-methylstyrene, an α-methylene aliphatic acid monocarboxylate, such as methyl acrylate, ethyl acrylate, n-propyl acrylate, lauryl acrylate, 2-ethylhexyl acrylate, methyl methacrylate, n-propyl methacrylate, lauryl methacrylate and 2-ethylhexyl methacrylate, a nitrogen-containing acrylic compound, such as dimethylaminoethyl methacrylate, a vinylnitrile compound, such as acrylonitrile and methacrylonitril, a vinylpyridine compound, such as 2-vinylpyridine and 4-vinylpyridine, a vinyl ether compound, such as vinyl methyl ether and vinyl isobutyl ether, a vinyl ketone compound, such as vinyl methyl ketone, vinyl ethyl ketone and vinyl isopropenyl ketone, an olefin, such as ethylene and propylene, and a fluorine-containing vinyl monomer, such as vinyldene fluoride, tetrafluoroethylene and hexafluoroethylene, a copolymer formed from two or more kinds thereof, a silicone compound, such as methylsilicone and methylphenylsilicone, a polyester containing bisphenol or glycol, an epoxy resin, a polyurethane resin, a polyamide resin, a cellulose resin, a polyether resin, and a polycarbonate resin. These resins may be used solely or in combination of two or more of them. Specific examples thereof include polytetrafluoroethylene, a homopolymer and/or a copolymer of a fluorine-containing compound, such as vinylidene fluoride and fluorinated ethylene, and a homopolymer and/or a copolymer of an unsaturated hydrocarbon, such as ethylene and propylene.

The fixing material, to which the toner image is to be fixed, may be paper, a resin film or the like. The fixing paper may be coated paper formed by coating a resin on a part or the whole of the surface of paper. The fixing resin film may also be a resin coated film formed by coating another resin on a part or the whole of the surface thereof. Resin fine particles or inorganic fine particles may be added to the paper and the resin film, so as to prevent duplicate delivery of the fixing material due to friction of the paper or the resin film or static charge caused by the friction, and to prevent deterioration in adhesion of the fixed image to the fixing material due to the releasing agent eluted to an interface between the fixing material and the fixed image upon fixing.

Specific examples of the coated resin for the paper and the resin film include a homopolymer of a styrene compound, such as styrene, parachlorostyrene and α-methylstyrene, an α-methylene aliphatic acid monocarboxylate, such as methyl acrylate, ethyl acrylate, n-propyl acrylate, lauryl acrylate, 2-ethylhexyl acrylate, methyl methacrylate, n-propyl methacrylate, lauryl methacrylate and 2-ethylhexyl methacrylate, a nitrogen-containing acrylic compound, such as dimethylaminoethyl methacrylate, a vinylnitrile compound, such as acrylonitrile and methacrylonitril, a vinylpyridine compound, such as 2-vinylpyridine and 4-vinylpyridine, a vinyl ether compound, such as vinyl methyl ether and vinyl isobutyl ether, a vinyl ketone compound, such as vinyl methyl ketone, vinyl ethyl ketone and vinyl isopropenyl ketone, an olefin, such as ethylene and propylene, and a fluorine-containing vinyl monomer, such as vinyldene fluoride, tetrafluoroethylene and hexafluoroethylene, a copolymer formed from two or more kinds thereof, a silicone compound, such as methylsilicone and methylphenylsilicone, a polyester containing bisphenol or glycol, an epoxy resin, a polyurethane resin, a polyamide resin, a cellulose resin, a polyether resin, and a polycarbonate resin. These resins maybe used solely or in combination of two or more of them.

Examples of the inorganic fine particles include those generally used as an external additive to the toner surface, such as silica, titania, calcium carbonate, magnesium carbonate, tricalcium phosphate, cerium oxide. Examples of the resin fine particles include those generally used as an external additive to the toner surface, such as a vinyl resin, a polyester resin and a silicone resin. The inorganic fine particles and the organic fine particles can be also used as a fluidity assistant and a cleaning assistant.

EXAMPLE

The invention will be described in more detail with reference to the following examples, but the invention is not construed as being limited thereto. In the following description, all "parts" means "parts by weight" unless otherwise indicated.

A toner according to the invention is produced in the following manner. A resin fine particle dispersion liquid, a colorant particle dispersion liquid and a releasing agent particle dispersion liquid shown below are respectively produced, and prescribed amounts of them are mixed, during which it is ionically neutralized by adding a polymer of an inorganic metallic salt, so as to form agglomerated bodies of the respective particles. After adjusting the pH in the system to a range of from mild acidity to neutral with an inorganic hydroxide, the system is heated to temperatures equal to or higher than the glass transition temperature of the resin fine particles, so as to fuse and integrate the agglomerated bodies. Thereafter, sufficient washing, solid-liquid separation and drying are carried out to obtain a desired toner. The preparation methods of the materials and the production method of the agglomerated particles are shown below.

(Preparation of Resin Fine Particle Dispersion Liquid 1)

| | |
|---|---|
| Styrene | 320 parts |
| n-Butyl acrylate | 80 parts |
| Acrylic acid | 6 parts |
| Dodecanethiol | 20 parts |
| Carbon tetrabromide | 4 parts |

The aforementioned components are mixed and dissolved. Separately, a solution obtained by dissolving 6 parts of a nonionic surfactant, NONIPOL 400 (produced by Sanyo Chemical Industries, Ltd.) and 10 parts of an anionic surfactant, NEOGEN SC (produced by Daiichi Kogyo Seiyaku Co., Ltd.) in 500 parts of ion exchanged water is placed in a flask, to which the aforementioned mixed solution is added, dispersed and emulsified, and then 50 parts of ion exchanged water having 4 parts of ammonium persulfate dissolved therein is added thereto while the system is slowly stirred and mixed over 10 minutes. After sufficiently replacing the system with nitrogen, the content of the flask is heated on an oil bath to 70° C. under stirring, and emulsion polymerization is continued for 5 hours. As a result, an anionic resin fine particle dispersion liquid having a center particle diameter of resin fine particles of 160 nm, a glass transition temperature of 58° C. and a weight average molecular weight Mw of 35,000 is obtained.

(Preparation of Resin Fine Particle Dispersion Liquid 2)

A resin fine particle dispersion liquid is prepared in the same manner as in the preparation of the resin fine particle dispersion liquid 1 except that the amount of styrene is changed to 310 parts, and the amount of n-butyl acrylate is changed to 90 parts, so as to obtain an anionic resin fine particle dispersion liquid having a center particle diameter of 170 nm, a glass transition temperature of 52° C. and a weight average molecular weight Mw of 34,000.

(Preparation of Resin Fine Particle Dispersion Liquid 3)

A resin fine particle dispersion liquid is prepared in the same manner as in the preparation of the resin fine particle dispersion liquid 1 except that the amount of styrene is changed to 315 parts, and the amount of n-butyl acrylate is changed to 85 parts, so as to obtain an anionic resin fine particle dispersion liquid having a center particle diameter of 170 nm, a glass transition temperature of 55° C. and a weight average molecular weight Mw of 36,000.

(Preparation of Colorant Particle Dispersion Liquid 1)

| | |
|---|---|
| Cyan pigment, PB15:3 (produced by Dainichiseika Color & Chemicals Mfg. Co., Ltd.) | 50 parts |
| Anionic surfactant, NEOGEN SC (produced by Daiichi Kogyo Seiyaku Co., Ltd.) | 5 parts |
| Ion exchanged water | 200 parts |

The aforementioned components are mixed and dissolved, and the mixture is dispersed by a homogenizer (ULTRA TURRAX, produced by IKA Works Inc.) and irradiation of ultrasonic wave, so as to obtain a colorant particle dispersion liquid having a center particle diameter of 167 nm.

(Preparation of Colorant Particle Dispersion Liquid 2)

A dispersion liquid having colorant particles dispersed therein having a center particle diameter of 159 nm is obtained in the same manner as in the preparation of the colorant particle dispersion liquid 1 except that a black pigment (carbon black, produced by Cabot Oil & Gas Corp.) is used as the colorant.

(Preparation of Releasing Agent Particle Dispersion 1)

| | |
|---|---|
| Polyethylene wax, PW500 (melting point: 81.3° C., produced by Toyo Petrolite Co., Ltd.) | 50 parts |
| Anionic surfactant, NEOGEN SC (solid content: 65%, produced by Daiichi Kogyo Seiyaku Co., Ltd.) | 2.3 parts |
| Ion exchanged water | 200 parts |

The aforementioned components are heated to 95° C. and sufficiently dispersed with an ULTRA TURRAX T50 homogenizer, produced by IKA Works Inc., and then the mixture is subjected to a dispersion treatment with a pressure discharge homogenizer, so as to obtain a releasing agent particle dispersion liquid having a center particle diameter of 280 nm.

(Preparation of Releasing Agent Particle Dispersion 2)

A releasing agent particle dispersion liquid having a center particle diameter of 290 nm is obtained in the same manner as in the preparation of the releasing agent particle dispersion liquid 1 except that the polyethylene wax PW500 is changed to polyethylene wax PW600 (melting point: 87.9° C., produced by Toyo Petrolite Co., Ltd.).

(Preparation of Releasing Agent Particle Dispersion 3)

A releasing agent particle dispersion liquid having a center particle diameter of 290 nm is obtained in the same manner as in the preparation of the releasing agent particle dispersion liquid 1 except that the polyethylene wax PW500 is changed to paraffin wax HNP9 (melting point: 77.7° C., produced by Nippon Seiro Co., Ltd.), and the amount of the anionic surfactant, NEOGEN SC (solid content: 65%, produced by Daiichi Kogyo Seiyaku Co., Ltd.) is changed to 3 parts.

(Preparation of Releasing Agent Particle Dispersion 4)

A releasing agent particle dispersion liquid having a center particle diameter of 300 nm is obtained in the same manner as in the preparation of the releasing agent particle dispersion liquid 1 except that the polyethylene wax PW500 is changed to polyethylene wax PW850 (melting point: 106.7° C., produced by Toyo Petrolite Co., Ltd.).

(Preparation of Releasing Agent Particle Dispersion 5)

A releasing agent particle dispersion liquid having a center particle diameter of 250 nm is obtained in the same manner as in the preparation of the releasing agent particle dispersion liquid 1 except that the polyethylene wax PW500 is changed to pentaerythritol distearate (melting point: 49.8° C).

(Preparation of Releasing Agent Particle Dispersion 6)

A releasing agent particle dispersion liquid having a center particle diameter of 290 nm is obtained in the same manner as in the preparation of the releasing agent particle dispersion liquid 3 except that the amount of the anionic surfactant, NEOGEN SC (solid content: 65%, produced by Daiichi Kogyo Seiyaku Co., Ltd.) is changed to 3.8 parts.

Example 1

| | |
|---|---|
| Resin fine particle dispersion 3 | 180 parts |
| Colorant particle dispersion 2 | 57 parts |
| Releasing agent particle dispersion 1 | 86 parts |
| Polyaluminum chloride (10% aqueous solution) | 2.4 parts |

The aforementioned components are sufficiently mixed and dispersed in a stainless steel round-bottom flask with an ULTRA TURRAX T50 homogenizer, produced by IKA Works Inc., and the mixture is then heated to 55° C. on a heating oil bath under stirring. After maintaining at 55° C. (initial heating temperature), 100 parts of the same resin fine particle dispersion liquid is gradually added thereto.

Thereafter, the pH in the system is adjusted to 6.5 by using a sodium hydroxide aqueous solution having a concentration of 0.5 mol/L, and then after sealing the stainless steel flask, the system is heated to 97° C. under continuous stirring with the stirring axis being magnetically sealed. After completing the reaction, the reaction mixture is cooled, filtrated and sufficiently washed with ion exchanged water, and then subjected to solid-liquid separation by Nutsche suction filtration. The resulting product is again dispersed by using 3 L of ion exchanged water at 40° C. and stirred and washed at 300 rpm for 15 minutes. The washing operation is repeated 5 times, and the product is subjected to solid-liquid separation by Nutsche suction filtration using No. 5 filter paper. The product is then continuously dried in vacuum for 12 hours to obtain a toner.

Measurement of the toner thus obtained with a COULTER COUNTER particle sizer reveals that the volume average particle diameter D50 of the toner is 6.5 μm, and the volume average particle size distribution index GSDv is 1.19. Shape observation of the toner with a LUZEX image analyzer, produced by Nireco Corp., reveals that the shape factor SF1 of the particles is 130, which indicates a roundish potato-like shape.

Example 2

Toner particles having an average particle diameter of 6.6 μm are obtained in the same manner as in Example 1 except that the combination of the dispersion liquids and the initial heating temperature are changed as follows.

| | |
|---|---|
| Resin fine particle dispersion 2 | 180 parts |
| Colorant particle dispersion 2 | 57 parts |

-continued

| | |
|---|---|
| Releasing agent particle dispersion 1 | 86 parts |
| Initial heating temperature: 52° C. | |

The toner has a volume average particle size distribution index GSDv of 1.19. Shape observation of the toner with a LUZEX image analyzer, produced by Nireco Corp., reveals that the shape factor SF1 of the particles is 132, which indicates a roundish potato-like shape.

Example 3

Toner particles having an average particle diameter of 5.8 μm are obtained in the same manner as in Example 1 except that the combination of the dispersion liquids and the initial heating temperature are changed as follows.

| | |
|---|---|
| Resin fine particle dispersion 2 | 180 parts |
| Colorant particle dispersion 2 | 57 parts |
| Releasing agent particle dispersion 2 | 86 parts |
| Initial heating temperature: 52° C. | |

The toner has a volume average particle size distribution index GSDv of 1.18. Shape observation of the toner with a LUZEX image analyzer, produced by Nireco Corp., reveals that the shape factor SF1 of the particles is 133, which indicates a roundish potato-like shape.

Example 4

Toner particles having an average particle diameter of 6.6 μm are obtained in the same manner as in Example 1 except that the combination of the dispersion liquids and the initial heating temperature are changed as follows, and the heating time at 52° C. is prolonged to increase the particle diameter.

| | |
|---|---|
| Resin fine particle dispersion 2 | 180 parts |
| Colorant particle dispersion 2 | 57 parts |
| Releasing agent particle dispersion 2 | 86 parts |
| Initial heating temperature: 52° C. | |

The toner has a volume average particle size distribution index GSDv of 1.19. Shape observation of the toner with a Luzex image analyzer, produced by Nireco Corp., reveals that the shape factor SF1 of the particles is 131, which indicates a roundish potato-like shape.

Example 5

Toner particles having an average particle diameter of 6.4 μm are obtained in the same manner as in Example 1 except that the combination of the dispersion liquids and the initial heating temperature are changed as follows.

| | |
|---|---|
| Resin fine particle dispersion 2 | 180 parts |
| Colorant particle dispersion 1 | 57 parts |
| Releasing agent particle dispersion 2 | 86 parts |
| Initial heating temperature: 52° C. | |

The toner has a volume average particle size distribution index GSDv of 1.19. Shape observation of the toner with a LUZEX image analyzer, produced by Nireco Corp., reveals that the shape factor SF1 of the particles is 131, which indicates a roundish potato-like shape.

Comparative Example 1

Toner particles having an average particle diameter of 6.5 μm are obtained in the same manner as in Example 1 except that the combination of the dispersion liquids and the initial heating temperature are changed as follows.

| | |
|---|---|
| Resin fine particle dispersion 2 | 180 parts |
| Colorant particle dispersion 2 | 57 parts |
| Releasing agent particle dispersion 3 | 86 parts |
| Initial heating temperature: 54° C. | |

The toner has a volume average particle size distribution index GSDv of 1.17. Shape observation of the toner with a LUZEX image analyzer, produced by Nireco Corp., reveals that the shape factor SF1 of the particles is 134, which indicates a roundish potato-like shape.

Comparative Example 2

Toner particles having an average particle diameter of 6.6 μm are obtained in the same manner as in Example 1 except that the combination of the dispersion liquids and the initial heating temperature are changed as follows.

| | |
|---|---|
| Resin fine particle dispersion 2 | 180 parts |
| Colorant particle dispersion 2 | 57 parts |
| Releasing agent particle dispersion 4 | 86 parts |
| Initial heating temperature: 52° C. | |

The toner has a volume average particle size distribution index GSDv of 1.18. Shape observation of the toner with a LUZEX image analyzer, produced by Nireco Corp., reveals that the shape factor SF1 of the particles is 133, which indicates a roundish potato-like shape.

Comparative Example 3

Toner particles having an average particle diameter of 6.5 μm are obtained in the same manner as in Example 1 except that the combination of the dispersion liquids and the initial heating temperature are changed as follows.

| | |
|---|---|
| Resin fine particle dispersion 2 | 180 parts |
| Colorant particle dispersion 2 | 57 parts |
| Releasing agent particle dispersion 5 | 86 parts |
| Initial heating temperature: 50° C. | |

The toner has a volume average particle size distribution index GSDv of 1.23. Shape observation of the toner with a LUZEX image analyzer, produced by Nireco Corp., reveals that the shape factor SF1 of the particles is 124, which indicates a substantially spherical shape.

Comparative Example 4

Toner particles having an average particle diameter of 6.4 μm are obtained in the same manner as in Example 1 except that the combination of the dispersion liquids and the initial heating temperature are changed as follows.

| | |
|---|---|
| Resin fine particle dispersion 1 | 180 parts |
| Colorant particle dispersion 2 | 57 parts |
| Releasing agent particle dispersion 1 | 86 parts |
| Initial heating temperature: 58° C. | |

The toner has a volume average particle size distribution index GSDv of 1.21. Shape observation of the toner with a LUZEX image analyzer, produced by Nireco Corp., reveals that the shape factor SF1 of the particles is 133, which indicates a roundish potato-like shape.

temperature. In this experiment, the expression "none" means that offset does not occur until 250° C.

(Image Quality Test)

A fixed image is formed by using a modified machine of VIVACE 500, produced by Fuji Xerox Co., Ltd., and uniformity of the image is visually observed.

(Dielectric Loss)

5 g of the resulting toner is molded in a circular molding machine having a diameter of 5 cm by applying a load of 10 t for 5 minutes, and the dielectric loss is measured at 5V and 1 KHz.

(Amount of Coarse Powder)

100 g of the toner is sieved through 1 mm mesh and 25 μm mesh overlapping each other, and coarse powder remaining on the 25 μm mesh is visually confirmed.

The results obtained are shown in Table 1 below.

TABLE 1

| | Example 1 | Example 2 | Example 3 | Example 4 | Example 5 | Comparative Example 1 | Comparative Example 2 | Comparative Example 3 | Comparative Example 4 |
|---|---|---|---|---|---|---|---|---|---|
| Pigment | Carbon | carbon | carbon | carbon | PB15:3 | carbon | carbon | carbon | carbon |
| Resin Tg | 55 | 52 | 52 | 52 | 52 | 52 | 52 | 52 | 58 |
| Wax species | PW500 | PW500 | PW600 | PW600 | PW600 | HNP9 | PW850 | PEDS(*) | PW500 |
| Wax mp | 81.3 | 81.3 | 87.9 | 87.9 | 87.9 | 77.7 | 106.7 | 49.8 | 81.3 |
| Wax content of Tg or less % [(a/b) × 100] | 7.0 | 4.1 | 3.8 | 3.8 | 3.8 | 0.0 | 2.3 | 95.0 | 10.2 |
| Toner diameter (μm) [c] | 6.5 | 6.6 | 5.8 | 6.6 | 6.4 | 6.5 | 6.6 | 6.5 | 6.4 |
| Surfactant/wax amount ratio | 3.0% | 3.0% | 3.0% | 3.0% | 3.0% | 3.0% | 3.0% | 3.0% | 3.0% |
| (a/b) × c | 0.46 | 0.27 | 0.22 | 0.25 | 0.24 | 0.00 | 0.15 | 6.18 | 0.65 |
| Coarse powder amount | none | none | none | none | none | large amount | none | large amount | large amount |
| Offset | none | none | none | none | none | none | 200 | 170 | none |
| Image quality | good | good | good | good | good | non-uniform | good | non-uniform | non-uniform |
| Dielectric loss | 0.02 | 0.02 | 0.03 | 0.03 | 0.03 | 0.06 | 0.02 | 0.06 | 0.02 |

Note:
(*)pentaerythritol distearate (Evaluation Method)

0.8% by weight of silica (TS720, produced by Cabot Oil & Gas Corp.) is added to and mixed with the toner particles to obtain a toner. A carrier is prepared by coating 1% by weight of polymethyl methacrylate (Soken Chemical Co., Ltd.) on a ferrite core having a diameter of 50 μm. The carrier and the toner are mixed to a toner concentration of 8% by weight to produce a developer.

(Measurement of Offset Temperature)

The offset temperature is measured by using a fixing device VIVACE 500, produced by Fuji Xerox Co., Ltd., which is modified to increasing the processing speed. The temperature of the heating roll is increased from 150 to 200° C. in steps of 5° C., and occurrence of offset is visually observed. The temperature at which offset occurs is designated as the offset (Preparation of Resin Fine Particle Dispersion Liquid 4)

| | |
|---|---|
| Styrene | 480 parts |
| n-Butyl acrylate | 119 parts |
| Dodecanethiol | 9.4 parts |
| Decanethiol diacrylate | 4.2 parts |
| Ion exchanged water | 250 parts |
| Anionic surfactant | 12 parts |

The aforementioned components are mixed and dissolved to prepare a mixed solution A. Separately, 1 part of an anionic surfactant (DOWFAX, produced by Dow Chemical Inc.) is dissolved in 550 parts of ion exchanged water, to which 430 parts of the mixed solution A is added, and dispersed in a flask for emulsification. Subsequently, 52 parts of ion exchanged water having 9 parts of ammonium persulfate dissolved therein is added thereto, and after sufficiently replacing the system with nitrogen, the system is heated to 70° C. under stirring in the flask, followed by continuing emulsion polymerization for 2 hours. Furthermore, a liquid formed by adding and emulsifying 5 parts of dodecanethiol in 444.6 parts of the mixed solution A is added to the system, which is subjected to emulsion polymerization at 70° C. for 3 hours, so as to obtain a resin fine particle dispersion 4 having a center particle diameter of fine particles of 178 nm, a glass transition temperature of 58.2° C., a weight average molecular weight of 38,000 and a solid content of 42%.

(Preparation of Resin Fine Particle Dispersion Liquid 5)

A resin fine particle dispersion liquid 5 is obtained in the same manner as in the preparation of the resin fine particle dispersion liquid 4 except that the amount of decanethiol diacrylate is changed to 6 parts. The resin fine particle dispersion liquid 5 has a center particle diameter of fine particles of 182 nm, a glass transition temperature of 57.5° C. and a weight average molecular weight of 42,000.

(Preparation of Resin Fine Particle Dispersion Liquid 6)

A resin fine particle dispersion liquid 6 is obtained in the same manner as in the preparation of the resin fine particle dispersion liquid 4 except that the amount of decanethiol diacrylate is changed to 18 parts. The resin fine particle dispersion liquid 6 has a center particle diameter of fine particles of 169 nm, a glass transition temperature of 56.4° C. and a weight average molecular weight of 45,000.

(Preparation of Resin Fine Particle Dispersion Liquid 7)

A resin fine particle dispersion liquid 7 is obtained in the same manner as in the preparation of the resin fine particle dispersion liquid 4 except that the amount of dodecanethiol is changed to 18.8 parts. The resin fine particle dispersion liquid 7 has a center particle diameter of fine particles of 180 nm, a glass transition temperature of 57.0° C. and a weight average molecular weight of 32,000.

(Preparation of Resin Fine Particle Dispersion Liquid 8)

A resin fine particle dispersion liquid 8 is obtained in the same manner as in the preparation of the resin fine particle dispersion liquid 4 except that the amount of decanethiol diacrylate is changed to 2.1 parts. The resin fine particle dispersion liquid 8 has a center particle diameter of fine particles of 175 nm, a glass transition temperature of 59.1° C. and a weight average molecular weight of 35,000.

(Preparation of Resin Fine Particle Dispersion Liquid 9)

A resin fine particle dispersion liquid 9 is obtained in the same manner as in the preparation of the resin fine particle dispersion liquid 8 except that the amount of dodecanethiol is changed to 2.1 parts. The resin fine particle dispersion liquid 9 has a center particle diameter of fine particles of 178 nm, a glass transition temperature of 59.8° C. and a weight average molecular weight of 42,000.

(Preparation of Colorant Particle Dispersion Liquid 3)

| | |
|---|---|
| Black pigment (carbon black, produced by Cabot Oil & Gas Corp.) | 50 parts |
| Nonionic surfactant (Nonipol 400, produced by Sanyo Chemical Industries, Ltd.) | 5 parts |
| Ion exchanged water | 200 parts |

The aforementioned components are mixed and dissolved, and the mixture is dispersed by a homogenizer (ULTRA TURRAX, produced by IKA Works Inc.) to obtain a colorant particle dispersion liquid 3 having a center particle diameter of 123 nm and a solid content of 21.5%.

(Preparation of Releasing Agent Particle Dispersion 7)

| | |
|---|---|
| Wax (melting point: 98° C., POLYWAX 725, produced by Toyo Petrolite Co., Ltd.) | 50 parts |
| Cationic surfactant (SANISOL B50, produced by Kao Corp.) | 5 parts |
| Ion exchanged water | 200 parts |

The aforementioned components are heated to 95° C. and sufficiently dispersed with a homogenizer (ULTRA TURRAX T50, produced by IKA Works Inc.), and then the mixture is subjected to a dispersion treatment with a pressure discharge homogenizer (GORIN Homogenizer, produced by Gorin Inc.), so as to obtain a releasing agent particle dispersion liquid 7 having a center particle diameter of 180 nm and a solid content of 21.0%.

Example 6

| | |
|---|---|
| Resin fine particle dispersion 4 | 278 parts |
| Colorant particle dispersion 3 | 60 parts |
| Releasing agent particle dispersion 7 | 88 parts |
| Polyaluminum chloride (10% aqueous solution) | 3.2 parts |

The aforementioned components are sufficiently mixed and dispersed in a stainless steel round-bottom flask with a homogenizer (ULTRA TURRAX T50, produced by IKA Works Inc.), and the mixture is then heated to 52° C. on a heating oil bath under stirring. After maintaining at 52° C. for 60 minutes, 137 parts of the resin fine particle dispersion liquid 4 is gradually added thereto, followed by stirring.

Thereafter, the pH in the system is adjusted to 6.5 by using a sodium hydroxide aqueous solution having a concentration of 0.5 mol/L, and then after sealing the stainless steel flask, the system is heated to 95° C. under continuous stirring with a magnetic seal. After completing the reaction, the reaction mixture is cooled, filtrated and sufficiently washed with ion exchanged water, and then subjected to solid-liquid separation by Nutsche suction filtration. The resulting product is again dispersed by using 3 L of ion exchanged water at 40° C. and stirred and washed at 300 rpm for 15 minutes.

The washing operation is repeated 5 times, and when the filtrate exhibits pH of 6.56, an electronic conductivity of 7.1 μS/cm and a surface tension of 71.0 dyn/cm, the product is subjected to solid-liquid separation by Nutsche suction filtration using No. 5 filter paper. The product is then continuously dried in vacuum for 12 hours to obtain toner particles.

Measurement of the particle diameter of the toner particles with a COULTER COUNTER particle sizer reveals that the volume average particle diameter D50 is 6.4 μm. Shape observation of the toner particles with a LUZEX image analyzer reveals that the shape factor SF1 of the toner particles is 132.

The toner particles have a weight average molecular weight Mw of 37,000 and a glass transition temperature Tg of 58.5° C. The toner particles have a crosslinking agent concentration of 0.7% by weight, an inorganic metallic salt amount of 0.16% by weight, and a value X of 98.

(Preparation of Developer)

1.2 parts of hydrophobic silica (TS720, produced by Cabot Oil & Gas Corp.) is added to 50 parts of the aforementioned toner particles and mixed in a sample mill to obtain an externally added toner. A ferrite carrier having an average particle diameter of 50 μm obtained by coating a ferrite core (produced by Powdertech Co., Ltd.) with 1% of polymethyl methacrylate (Soken Chemical Co., Ltd.) and the aforementioned externally added toner are weighed to a toner concentration of 5%, and they are stirred and mixed in a ball mill for 5 minutes to prepare a developer.

(Evaluation of Toner)

A toner image is formed by using a modified machine of DOCUCOLOR 1250, produced by Fuji Xerox Co., Ltd., having the aforementioned developer applied thereto, in which ST Paper, produced by Fuji Xerox Co., Ltd. is used as transfer paper, and the toner amount is adjusted to 0.60 g/m$^2$. Thereafter, the image is fixed by using an external fixing device at a nip of 5.0 mm, a process speed of 300 mm/s and a fixing temperature adjusted to 250° C. to evaluate the fixing property of the toner. It is confirmed that the oilless fixing property with a PFA tube roller is good, and the transfer paper is released with no resistance. The fixing property of the toner is evaluated at a fixing temperature adjusted to 150° C. The fixing sheet having a fixed image is folded into two and is strongly rubbed with nails, and the sheet is again opened. The fixing property of the fixed image on the fixing sheet is good, and no defect is found at the folded part. Thus, it is confirmed that excellent folding resistance is obtained.

Measurement of charging property of the toner reveals good charging property of −35 μC/g at 23° C. and 60% RH (ordinary environment), −39 μC/g at 10° C. and 30% RH (winter season environment), and −29 μC/g at 28° C. and 85% RH (summer season environment), and thus it is confirmed that excellent environment dependency is obtained. The resulting image is sharp, and scattering of the toner and defects, such as fogging, are not observed.

Example 7

A toner is obtained in the same manner as in the preparation of the toner particles in Example 6 except that the amount of polyaluminum chloride (PAC) is changed from 3.2 parts to 3.6 parts.

Measurement of the particle diameter of the toner particles with a COULTER COUNTER particle sizer reveals that the accumulated volume average particle diameter D50 is 6.1 μm. Shape observation of the toner particles with a LUZEX image analyzer reveals that the shape factor SF1 of the toner particles is 129.

The toner particles have a weight average molecular weight Mw of 36,000 and a glass transition temperature Tg of 57.8° C. The toner particles have a crosslinking agent concentration of 0.7% by weight, an inorganic metallic salt amount of 0.18% by weight, and a value X of 115.

(Preparation of Developer)

A developer is prepared in the same manner as in Example 6 except that 50 parts of the toner particles produced in Example 7 is used.

(Evaluation of Toner)

The developer obtained in Example 7 is evaluated in the same manner as in Example 6.

The fixing property of the toner is evaluated at a fixing temperature adjusted to 250° C., and it is confirmed that the oilless fixing property with a PFA tube roller is good, and the transfer paper is released with no resistance. The fixing property of the toner is evaluated at a fixing temperature adjusted to 150° C. The fixing sheet having a fixed image is folded into two and is strongly rubbed with nails, and the sheet is again opened. The fixing property of the fixed image on the fixing sheet is good, and no defect is found at the folded part. Thus, it is confirmed that excellent folding resistance is obtained.

Measurement of charging property of the toner reveals good charging property of −32 μC/g at 23° C. and 60% RH (ordinary environment), −36 μC/g at 10° C. and 30% RH (winter season environment), and −29 μC/g at 28° C. and 85% RH (summer season environment), and thus it is confirmed that excellent environment dependency is obtained. The resulting image is sharp, and scattering of the toner and defects, such as fogging, are not observed.

Example 8

A toner is obtained in the same manner as in the preparation of the toner particles in Example 7 except that the resin fine particle dispersion liquid 4 is changed to the resin fine particle dispersion liquid 5.

Measurement of the particle diameter of the toner particles with a COULTER COUNTER particle sizer reveals that the accumulated volume average particle diameter D50 is 6.4 μm. Shape observation of the toner particles with a LUZEX image analyzer reveals that the shape factor SF1 of the toner particles is 132.

The toner particles have a weight average molecular weight Mw of 41,000 and a glass transition temperature Tg of 58.0° C. The toner particles have a crosslinking agent concentration of 1.0% by weight, an inorganic metallic salt amount of 0.18% by weight, and a value X of 122.

(Preparation of Developer)

A developer is prepared in the same manner as in Example 6 except that 50 parts of the toner particles produced in Example 8 is used.

(Evaluation of Toner)

The developer obtained in Example 8 is evaluated in the same manner as in Example 6.

The fixing property of the toner is evaluated at a fixing temperature adjusted to 250° C., and it is confirmed that the oilless fixing property with a PFA tube roller is good, and the transfer paper is released with no resistance. The fixing property of the toner is evaluated at a fixing temperature adjusted to 150° C. The fixing sheet having a fixed image is folded into two and is strongly rubbed with nails, and the sheet is again opened. The fixing property of the fixed image on the fixing sheet is good, and no defect is found at the folded part. Thus, it is confirmed that excellent folding resistance is obtained.

Measurement of charging property of the toner reveals good charging property of −32 μC/g at 23° C. and 60% RH (ordinary environment), −36 μC/g at 10° C. and 30% RH (winter season environment), and −29 μC/g at 28° C. and 85% RH (summer season environment), and thus it is confirmed that excellent environment dependency is obtained. The resulting image is sharp, and scattering of the toner and defects, such as fogging, are not observed.

Example 9

A toner is obtained in the same manner as in the preparation of the toner particles in Example 7 except that the resin fine particle dispersion liquid 4 is changed to the resin fine particle dispersion liquid 6.

Measurement of the particle diameter of the toner particles with a COULTER COUNTER particle sizer reveals that the volume average particle diameter D50 is 6.8 μm. Shape observation of the toner particles with a LUZEX image analyzer reveals that the shape factor SF1 of the toner particles is 138.

The toner particles have a weight average molecular weight Mw of 43,000 and a glass transition temperature Tg of 57.2° C. The toner particles have a crosslinking agent concentration of 3.0% by weight, an inorganic metallic salt amount of 0.16% by weight, and a value X of 151.

(Preparation of Developer)

A developer is prepared in the same manner as in Example 6 except that 50 parts of the toner particles produced in Example 9 is used.

(Evaluation of Toner)

The developer obtained in Example 9 is evaluated in the same manner as in Example 6.

The fixing property of the toner is evaluated at a fixing temperature adjusted to 250° C., and it is confirmed that the oilless fixing property with a PFA tube roller is good, and the transfer paper is released with no resistance. The fixing property of the toner is evaluated at a fixing temperature adjusted to 150° C. The fixing sheet having a fixed image is folded into two and is strongly rubbed with nails, and the sheet is again opened. The fixing property of the fixed image on the fixing sheet is good, and no defect is found at the folded part. Thus, it is confirmed that excellent folding resistance is obtained.

Measurement of charging property of the toner reveals good charging property of −34 μC/g at 23° C. and 60% RH (ordinary environment), −37 μC/g at 10° C. and 30% RH (winter season environment), and −30 μC/g at 28° C. and 85% RH (summer season environment), and thus it is confirmed that excellent environment dependency is obtained. The resulting image is sharp, and scattering of the toner and defects, such as fogging, are not observed.

Example 10

A toner is obtained in the same manner as in the preparation of the toner particles in Example 6 except that the resin fine particle dispersion liquid 4 is changed to the resin fine particle dispersion liquid 7.

Measurement of the particle diameter of the toner particles with a COULTER COUNTER particle sizer reveals that the accumulated volume average particle diameter D50 is 6.8 μm. Shape observation of the toner particles with a LUZEX image analyzer reveals that the shape factor SF1 of the toner particles is 132.

The toner particles have a weight average molecular weight Mw of 31,000 and a glass transition temperature Tg of 57.8° C. The toner particles have a crosslinking agent concentration of 1.0% by weight, an inorganic metallic salt amount of 0.16% by weight, and a value X of 105.

(Preparation of Developer)

A developer is prepared in the same manner as in Example 6 except that 50 parts of the toner particles produced in Example 10 is used.

(Evaluation of Toner)

The developer obtained in Example 10 is evaluated in the same manner as in Example 6.

The fixing property of the toner is evaluated at a fixing temperature adjusted to 250° C., and it is confirmed that the oilless fixing property with a PFA tube roller is good, and the transfer paper is released with no resistance. The fixing property of the toner is evaluated at a fixing temperature adjusted to 150° C. The fixing sheet having a fixed image is folded into two and is strongly rubbed with nails, and the sheet is again opened. The fixing property of the fixed image on the fixing sheet is good, and no defect is found at the folded part. Thus, it is confirmed that excellent folding resistance is obtained.

Measurement of charging property of the toner reveals good charging property of −38 μC/g at 23° C. and 60% RH (ordinary environment), −42 μC/g at 10° C. and 30% RH (winter season environment), and −31 μC/g at 28° C. and 85% RH (summer season environment), and thus it is confirmed that excellent environment dependency is obtained. The resulting image is sharp, and scattering of the toner and defects, such as fogging, are not observed.

Comparative Example 5

A toner is obtained in the same manner as in the preparation of the toner particles in Example 6 except that the resin fine particle dispersion liquid 4 is changed to the resin fine particle dispersion liquid 8, and the amount of PAC is changed from 3.2 parts to 2.8 parts.

Measurement of the particle diameter of the toner particles with a COULTER COUNTER particle sizer reveals that the accumulated volume average particle diameter D50 is 6.5 μm. Shape observation of the toner particles with a LUZEX image analyzer reveals that the shape factor SF1 of the toner particles is 135.

The toner particles have a weight average molecular weight Mw of 33,000 and a glass transition temperature Tg of 57.9° C. The toner particles have a crosslinking agent concentration of 0.35% by weight, an inorganic metallic salt amount of 0.14% by weight, and a value X of 72.

(Preparation of Developer)

A developer is prepared in the same manner as in Example 6 except that 50 parts of the toner particles produced in Comparative Example 5 is used.

(Evaluation of Toner)

The developer obtained in Comparative Example 5 is evaluated in the same manner as in Example 6.

The fixing property of the toner is evaluated at a fixing temperature adjusted to 250° C., and hot offset is observed in oilless fixing property with a PFA tube roller. The fixing property of the toner is evaluated at a fixing temperature adjusted to 150° C. The fixing sheet having a fixed image is folded into two and is strongly rubbed with nails, and the sheet is again opened. The fixing property of the fixed image on the fixing sheet is good, and no defect is found at the folded part. Thus, it is confirmed that excellent folding resistance is obtained.

Measurement of charging property of the toner reveals good charging property of −38 μC/g at 23° C. and 60% RH (ordinary environment), −42 μC/g at 10° C. and 30% RH (winter season environment), and −31 μC/g at 28° C. and 85% RH (summer season environment), and thus it is confirmed that excellent environment dependency is obtained. The resulting image is sharp, and scattering of the toner and defects, such as fogging, are not observed.

Comparative Example 6

A toner is obtained in the same manner as in the preparation of the toner particles in Comparative Example 5 except that the amount of PAC is changed from 2.8 parts to 3.2 parts.

Measurement of the particle diameter of the toner particles with a COULTER COUNTER particle sizer reveals that the volume average particle diameter D50 is 6.3 μm. Shape observation of the toner particles with a LUZEX image analyzer reveals that the shape factor SF1 of the toner particles is 129.

The toner particles have a weight average molecular weight Mw of 32,000 and a glass transition temperature Tg of 58.2° C. The toner particles have a crosslinking agent concentration of 0.35% by weight, an inorganic metallic salt amount of 0.16% by weight, and a value X of 90.

(Preparation of Developer)

A developer is prepared in the same manner as in Example 6 except that 50 parts of the toner particles produced in Comparative Example 6 is used.

(Evaluation of Toner)

The developer obtained in Comparative Example 6 is evaluated in the same manner as in Example 6.

The fixing property of the toner is evaluated at a fixing temperature adjusted to 250° C., and hot offset is observed in oilless fixing property with a PFA tube roller. The fixing property of the toner is evaluated at a fixing temperature adjusted to 150° C. The fixing sheet having a fixed image is folded into two and is strongly rubbed with nails, and the sheet is again opened. The fixing property of the fixed image on the fixing sheet is good, and no defect is found at the folded part. Thus, it is confirmed that excellent folding resistance is obtained.

Measurement of charging property of the toner reveals good charging property of −38 μC/g at 23° C. and 60% RH (ordinary environment), −42 μC/g at 10° C. and 30% RH (winter season environment), and −31 μC/g at 28° C. and 85% RH (summer season environment), and thus it is confirmed that excellent environment dependency is obtained. The resulting image is sharp, and scattering of the toner and defects, such as fogging, are not observed.

Comparative Example 7

A toner is obtained in the same manner as in the preparation of the toner particles in Example 6 except that the resin fine particle dispersion liquid 4 is changed to the resin fine particle dispersion liquid 9, and the amount of PAC is changed from 3.2 parts to 2.8 parts.

(Preparation of Developer)

A developer is prepared in the same manner as in Example 6 except that 50 parts of the toner particles produced in Comparative Example 7 is used.

(Evaluation of Toner)

The developer obtained in Comparative Example 7 is evaluated in the same manner as in Example 6.

The fixing property of the toner is evaluated at a fixing temperature adjusted to 250° C., and hot offset is observed in oilless fixing property with a PFA tube roller. The fixing property of the toner is evaluated at a fixing temperature adjusted to 150° C. The fixing sheet having a fixed image is folded into two and is strongly rubbed with nails, and the sheet is again opened. The fixing property of the fixed image on the fixing sheet is good, and no defect is found at the folded part. Thus, it is confirmed that excellent folding resistance is obtained.

Measurement of charging property of the toner reveals good charging property of −38 μC/g at 23° C. and 60% RH (ordinary environment), −42 μC/g at 10° C. and 30% RH (winter season environment), and −31 μC/g at 28° C. and 85% RH (summer season environment), and thus it is confirmed that excellent environment dependency is obtained. The resulting image is sharp, and scattering of the toner and defects, such as fogging, are not observed.

The measurement results and the evaluation results of the toners and the developers obtained in Examples 6 to 10 and Comparative Examples 5 to 7 are shown in Table 2 below.

TABLE 2

| | Example 6 | Example 7 | Example 8 | Example 9 | Example 10 | Comparative Example 5 | Comparative Example 6 | Comparative Example 7 |
|---|---|---|---|---|---|---|---|---|
| Mw | 37,000 | 36,000 | 41,000 | 43,000 | 31,000 | 33,000 | 32,000 | 40,000 |
| Tg (° C.) | 58.5 | 57.8 | 58.0 | 57.2 | 57.8 | 57.9 | 58.2 | 59.2 |
| Cross-linking agent amount (wt %) | 0.7 | 0.7 | 1.0 | 3.0 | 1.0 | 0.35 | 0.35 | 0.35 |
| Inorganic metallic salt amount (wt %) | 0.16 | 0.18 | 0.18 | 0.16 | 0.16 | 0.14 | 0.16 | 0.14 |
| X | 98 | 115 | 122 | 151 | 105 | 72 | 90 | 72 |
| Fixing property (250°) | good | good | good | good | good | poor | poor | poor |
| Fixing property (150°) | good | good | good | good | good | good | good | good |
| Total evaluation | good | good | good | good | good | poor | poor | poor |

Measurement of the particle diameter of the toner particles with a COULTER COUNTER particle sizer reveals that the volume average particle diameter D50 is 6.3 μm. Shape observation of the toner particles with a LUZEX image analyzer reveals that the shape factor SF1 of the toner particles is 131.

The toner particles have a weight average molecular weight Mw of 40,000 and a glass transition temperature Tg of 59.2° C. The toner particles have a crosslinking agent concentration of 0.35% by weight, an inorganic metallic salt amount of 0.14% by weight, and a value X of 72.

What is claimed is:

1. A toner for developing an electrostatic image, comprising a binder resin having a glass transition onset temperature of from 45 to 70° C., a colorant and a releasing agent, wherein the releasing agent has an endothermic peak temperature measured by a differential scanning calorimeter in a range of from 60 to 100° C. and has an average dispersion particle diameter in the toner of from 150 to 1,500 nm, and the toner satisfies the following equation:

$$0.05 \leqq (a/b) \times c \leqq 0.6$$

where a is an endothermic amount of the releasing agent per unit weight (J/g) at temperatures equal to or lower than a glass transition onset temperature of the binder resin, measured by the differential scanning calorimeter;

b is a total endothermic amount of the releasing agent per unit weight (J/g); and c is a volume average particle diameter of the toner and is in unit of μm.

2. The toner according to claim 1, wherein the toner has a weight average molecular weight of from 20,000 to 90,000.

3. The toner according to claim 1, wherein the releasing agent is in a range of from 5 to 25% by weight based on the total weight of the toner.

4. The toner according to claim 1, wherein the toner has a shape factor SF1 of from 110 to 140 and the shape factor SF1 is defined by $$SF1=(ML^2/A)\times(\pi/4)\times100$$

where ML represents a maximum length of particles of the toner, and A represents a projected area of the particles.

5. A toner for developing an electrostatic image comprising, a binder resin having a glass transition onset temperature of from 45 to 70° C., a colorant and a releasing agent, wherein the releasing agent has an endothermic peak temperature measured by a differential scanning calorimeter in a range of from 70 to 98° C., and the toner satisfies the following equation:

$$0.2\leqq(a/b)\times c\leqq0.5$$

where a is an endothermic amount of the releasing agent per unit weight (J/g) at temperatures equal to or lower than a glass transition onset temperature of the binder resin, measured by the differential scanning calorimeter;

b is a total endothermic amount of the releasing agent per unit weight (J/g); and c is a volume average particle diameter of the toner and is in unit of μm.

6. A toner for developing an electrostatic image, comprising a binder resin having a glass transition onset temperature of from 45 to 70° C., a colorant and a releasing agent, wherein the releasing agent has an endothermic peak temperature measured by a differential scanning calorimeter in a range of from 60 to 100° C., and the toner satisfies the following equation:

$$0.05\leqq(a/b)\times c\leqq0.6$$

where a is an endothermic amount of the releasing agent per unit weight (J/g) at temperatures equal to or lower than a glass transition onset temperature of the binder resin, measured by the differential scanning calorimeter;

b is a total endothermic amount of the releasing agent per unit weight (J/g); and c is a volume average particle diameter of the toner and is in unit of μm wherein the binder resin further comprises a crosslinked structure; and wherein the toner further comprises an inorganic metallic salt having two or more valences; the toner has a volume average particle diameter of from 3 to 9 μm; and a value X represented by the following equation of from 97 to 250:

$$X=874.8\times B/4\times C+23.1\times D-58.2$$

where

B represents valence number of the inorganic metallic salt;

C represents an amount of the inorganic metallic salt expressed as percent by weight based on the total weight of the total solid content of the toner; and D represents a concentration of a crosslinking agent expressed as percent by weight based on the total weight of the binder resin; and wherein the crosslinking agent includes an aliphatic compound.

7. The toner according to claim 6, wherein the inorganic metallic salt includes polyaluminum chloride.

8. A method of producing a toner including at least a binder resin having a glass transition onset temperature of from 45 to 70° C., a colorant and a releasing agent for developing an electrostatic image, comprising:

preparing a resin particle dispersion liquid including resin particles having a particle diameter of 1 μm or less dispersed therein, a colorant particle dispersion liquid and a releasing agent dispersion liquid;

mixing the resin particle dispersion liquid, the colorant particle dispersion liquid and the releasing agent dispersion liquid;

preparing a dispersion liquid of agglomerated particles of the resin particles, colorant particles and releasing agent particles; and heating the agglomerated particles at temperatures equal to or higher than a glass transition temperature of the resin particles to fuse and integrate the agglomerated particles wherein the releasing agent has an endothermic peak temperature measured by a differential scanning calorimeter in a range of from 60 to 100° C. and has an average dispersion particle diameter in the toner of from 150 to 1,500 nm, and the toner satisfies the following equation:

$$0.05\leqq(a/b)\times c\leqq0.6$$

where a is an endothermic amount of the releasing agent per unit weight (J/g) at temperatures equal to or lower than a glass transition onset temperature of the binder resin, measured by the differential scanning calorimeter;

b is a total endothermic amount of the releasing agent per unit weight (J/g); and c is a volume average particle diameter of the toner and is in unit of μm.

9. The method according to claim 8, wherein preparing the dispersion liquid of agglomerated particles includes using an inorganic metallic salt having two or more valences as an agglomerating agent.

10. The method according to claim 9, wherein the inorganic metallic salt having two or more valences is polyaluminum chloride.

11. The method according to claim 8, wherein the toner has a shape factor SF1 in a range from 110 to 140 and the shape factor is defined by $$SF1=(ML^2/A)\times(\pi/4)\times100$$

where ML represents a maximum length of particles of the toner, and A represents a projected area of the particles.

12. A developer for developing an electrostatic image comprising a carrier and a toner including a binder resin having a glass transition onset temperature of from 45 to 70° C., a colorant and a releasing agent, wherein the releasing agent has an endothermic peak temperature measured by a differential scanning calorimeter in a range of from 60 to 100° C.

and has an average dispersion particle diameter in the toner of from 150 to 1,500 nm, the toner satisfies the following equations:

$$0.05 \leqq (a/b) \times c \leqq 0.6$$

where a is an endothermic amount of the releasing agent per unit weight (J/g) at temperatures equal to or lower than a glass transition onset temperature of the binder resin, measured by the differential scanning calorimeter;

b is a total endothermic amount of the releasing agent per unit weight (J/g); and c is a volume average particle diameter of the toner and is in unit of μm.

13. A method for forming an image comprising:

forming an electrostatic latent image on an electrostatic image carrier;

developing the electrostatic latent image on the electrostatic image carrier with a developer to form a toner image;

transferring the toner image to a transfer material; and fixing the toner image, wherein the developer comprises a carrier and a toner including a binder resin having a glass transition onset temperature of from 45 to 70° C., a colorant and a releasing agent, wherein the releasing agent has an endothermic peak temperature measured by a differential scanning calorimeter of from 60 to 100° C. and has an average dispersion diameter in the toner of from 150 to 1,500 nm, and the toner satisfies the following equations:

$$0.05 \leqq (a/b) \times c \leqq 0.6$$

where a is an endothermic amount of the releasing agent per unit weight (J/g) at temperatures equal to or lower than a glass transition onset temperature of the binder resin, measured by the differential scanning calorimeter;

b is a total endothermic amount of the releasing agent per unit weight (J/g); and c is a volume average particle diameter of the toner and is in unit of μm.

14. The method according to claim 13, wherein the toner has a shape factor SF1 in a range from 110 to 140 and the shape factor is defined by $$SF1 = (ML^2/A) \times (\pi/4) \times 100$$

where ML represents a maximum length of particles of the toner, and A represents a projected area of the particles.

* * * * *